US012258772B2

(12) United States Patent
Baek

(10) Patent No.: US 12,258,772 B2
(45) Date of Patent: Mar. 25, 2025

(54) SHADE TARP USING ADVERTISING BALLOON

(71) Applicant: Jin Heum Baek, Gyeongsangnam-do (KR)

(72) Inventor: Jin Heum Baek, Gyeongsangnam-do (KR)

( * ) Notice: Subject to any disclaimer, the term of this patent is extended or adjusted under 35 U.S.C. 154(b) by 308 days.

(21) Appl. No.: 17/557,521

(22) Filed: Dec. 21, 2021

(65) Prior Publication Data

US 2022/0112739 A1 Apr. 14, 2022

Related U.S. Application Data

(63) Continuation of application No. PCT/KR2020/009086, filed on Jul. 10, 2020.

(30) Foreign Application Priority Data

Jul. 16, 2019 (KR) ..... 10-2019-0086574
Jul. 9, 2020 (KR) ..... 10-2020-0084953

(51) Int. Cl.
*E04H 15/20* (2006.01)
*E04H 15/54* (2006.01)
(Continued)

(52) U.S. Cl.
CPC ..... *E04H 15/20* (2013.01); *E04H 15/54* (2013.01); *E04H 15/58* (2013.01); *E04H 15/14* (2013.01); *E04H 2015/201* (2013.01)

(58) Field of Classification Search
CPC ..... E04H 15/20; E04H 15/54; E04H 15/14; E04H 2015/201; E04H 1/1205;
(Continued)

(56) References Cited

U.S. PATENT DOCUMENTS 2,946,337 A * 7/1960 Wolshin ..... E04H 15/20 52/2.21
3,245,405 A * 4/1966 Gardner ..... A61F 13/00051 128/DIG. 20
(Continued)

FOREIGN PATENT DOCUMENTS

JP 1995071120 A 3/1995
JP 2000282716 A 10/2000
(Continued)

OTHER PUBLICATIONS

International Search Report for International Application No. PCT/KR2020/009086, mailed Dec. 8, 2020, 2 pages.
(Continued)

*Primary Examiner* — Brent W Herring

(74) *Attorney, Agent, or Firm* — Guntin & Gust, PLC; Miyoung Shin

(57) ABSTRACT

The present disclosure relates to a shade tarp using an advertising balloon. The shade tarp includes a frame including an outer frame into which gas is injected and an inner frame provided inside the outer frame; a cover portion configured to cover an inner space formed inside the frame; and a connector configured to connect the cover portion to the frame, wherein the connector connects the cover portion to the frame so that the cover portion is movable with respect to the frame.

19 Claims, 38 Drawing Sheets

(51) Int. Cl.
*E04H 15/58* (2006.01)
*E04H 15/14* (2006.01)

(58) Field of Classification Search
CPC . E04H 15/204; E04H 15/58; E04H 2015/206; E04B 1/388; E04B 1/92; F24F 7/00; G09F 21/06
USPC ..... 52/2.11, 2.18
See application file for complete search history.

(56) References Cited

U.S. PATENT DOCUMENTS 5,005,322 A * 4/1991 Mattick ..... E04H 15/20 52/25
5,076,029 A * 12/1991 Sevilla ..... E04H 15/58 244/33
6,008,938 A * 12/1999 Suehle ..... E01F 9/654 359/443
6,209,149 B1 * 4/2001 Song ..... E04H 15/20 4/503
6,408,453 B1 * 6/2002 Song ..... E04H 4/103 4/499
6,571,815 B1 * 6/2003 Hill ..... E04H 15/58 135/117
11,202,488 B1 * 12/2021 Wan ..... E04H 6/42
2012/0131857 A1 * 5/2012 Ross-da Silva ..... E04H 15/20 52/2.18

FOREIGN PATENT DOCUMENTS

KR 100758224 B1 9/2007
KR 1020150004163 A 1/2015
KR 2020150000726 U 2/2015
KR 1020170049947 A 5/2017
KR 1020190005325 A 1/2019

OTHER PUBLICATIONS

Office Action issued in Korean counterpart application No. 10-2020-0084953 on Nov. 25, 2020, 7 pages.
Notice of Allowance issued to corresponding KR Application No. 10-2020-0084953, issued Mar. 12, 2021, 3 pages.

* cited by examiner

SHADE TARP USING ADVERTISING BALLOON

CROSS-REFERENCE OF RELATED APPLICATIONS AND PRIORITY

The present application is a continuation of International Application No. PCT/KR2020/009086 filed Jul. 10, 2020, which claims priority to Korean Patent Applications Nos. 10-2019-0086574 filed Jul. 16, 2019 and 10-2020-0084953 filed Jul. 9, 2020, the disclosure of which are incorporated by reference as if they are fully set forth herein.

TECHNICAL FIELD

The present disclosure relates to a shade tarp using an advertising balloon, and more particularly, to a shade tarp using an advertising balloon in which as a cover portion is upward-movably installed on a frame that is lifted into the air by injecting gas into the frame, ventilation is possible between the frame and the cover portion and shade is provided under the frame by the cover portion that floats high in the air.

BACKGROUND

In general, shade tarps for blocking sunlight are installed in outdoor event spaces or parks. Shade tarps may be classified into shade tarps with supports and shade tarps without supports. When a shade tarp without supports is small, several pillars are installed at end portions of the shade tarp rather than at a central portion of the shade tarp and a sunlight-blocking fabric is placed over the pillars.

However, when a shade tarp is large, several supports are installed at end portions of the shade tarp, and then a support is also installed even at a central portion of the shade portion in order to prevent the central portion of the shade tarp from sagging due to gravity.

A shade tarp without supports usually has rings at four corners of end portions of the shade tarp having a quadrangular flat shape, and four ropes are fastened to the rings, are tightly pulled to spread out the quadrangular shade tarp, and then are connected to pillars or corners.

However, a shade tarp in the related art has problems in that because the shade tarp has a low height and thus has poor ventilation, a space under the shade tarp is too hot in summer, and when a support is installed at a central portion of the shade tarp, it is difficult to place equipment such as large chairs or tables in an event space.

Also, the shade tarp has problems in that the shade tarp may block the view and cause inconvenience in movement and activities, and above all, when the shade tarp is installed wide, long, and high, the shade tarp may collapse due to strong wind and installation cost may increase.

Advertising balloons containing helium or hydrogen are often used in advertisements for various gams or events by floating high in the air. An advertising balloon with no ventilation function in the related art has problems in that when the advertising balloon is too large, a rope may break or the advertising balloon may be damaged due to strong wind, and because of the weight of the advertising balloon, it is difficult to form another structure over the advertising balloon.

SUMMARY

To solve the above drawbacks, the present disclosure more particularly relates to a shade tarp using an advertising balloon in which as a cover portion is upward-movably installed on a frame that is lifted into the air by injecting gas into the frame, ventilation is possible between the frame and the cover portion and shade is provided under the frame through the cover portion that floats high in the air.

A shade tarp using an advertising balloon of the present disclosure for solving the above problems includes: a frame including an outer frame into which gas is injected and an inner frame provided inside the outer frame; a cover portion configured to cover an inner space formed inside the frame; and a connector configured to connect the cover portion to the frame, wherein the connector connects the cover portion to the frame so that the cover portion is movable with respect to the frame.

The cover portion may include an edge portion to which the connector is combined, and a sun-shielding portion provided inside the edge portion, wherein gas is injected into the sun-shielding portion.

An outer cord for fixing the outer frame may be provided on the outer frame, and an inner cord for fixing the inner frame may be provided on the inner frame.

A base support having an end and the other end combined to the frame may be provided in the inner space formed inside the frame.

A plurality of base supports may be combined in the inner space formed inside the frame, wherein an end and the other end of each of the plurality of base supports are combined to any one point of an upper portion, a middle portion, and a lower portion of the frame.

The connector may include a movable portion having a bar shape combined to protrude toward an upper portion of the frame, and a lid portion provided on an end of the movable portion, wherein a connection hole is formed in the cover portion, and the cover portion is fitted to the movable portion through the connection hole, and the lid portion has a width greater than a width of the connection hole of the cover portion.

The movable portion may be combined to a top surface of the frame or an inner surface of the frame.

The cover portion may be fitted to the movable portion and movable, or may be fitted to the movable portion and fixed to an upper portion of the movable portion.

The connector may include a first connector configured to connect a side of the cover portion to the frame so that the side of the cover portion is movable upward with respect to the frame, and a second connector configured to connect the other side of the cover portion to the frame so that the other side of the cover portion is fixedly combined to the frame so as not to be movable upward, wherein the cover portion is hinged to the frame so that only the side of the cover portion is movable upward.

The first connector may connect the cover portion to the side of the frame, and may include a first movable portion having a bar shape and combined to protrude toward an upper portion of the frame and a first lid portion provided on an end of the first movable portion, wherein the first movable portion extends in an upward oblique direction with respect to the frame.

A spring may be provided on the second connector.

The connector may include a first connector configured to connect a side of the cover portion to the frame so that the side of the cover portion is movable upward with respect to the frame, a second connector configured to connect a middle portion of the cover portion to the frame, while the middle portion of the cover portion is fixedly combined to the frame so that the middle portion of the cover portion is not movable upward with respect to the frame, and a third connector configured to connect the other side of the cover portion to the frame so that the other side of the cover portion is movable upward with respect to the frame.

The frame may have a cylindrical shape, and include a twisted portion in which the frame twisted.

The twisted portion may be twisted two to three times, wherein a fixing cover is combined to the twisted portion, and has any one of an L-shape, a T-shape, and a cross shape.

The frame may include a rope fixing member, and may further include a rope inserted into the rope fixing member, wherein the rope extends below the frame, wherein the connector connects the cover portion to the rope so that the cover portion is movable with respect to the frame.

A moving fixing portion that does not pass through the rope fixing member may be provided on the rope.

The cover portion may include a plurality of layers.

The frame may have a double-layer structure including a first frame into which gas is injected and a second frame that surrounds the first frame and into which gas is injected.

The shade tarp may further include a safety net having a net shape and configured to cover the frame, an auxiliary cover portion combined to the safety net or the frame and configured to cover the inner space formed in the frame, and an auxiliary connector configured to connect the auxiliary cover portion to the safety net or the frame.

The frame may be installed on a support structure installed on the ground.

The present disclosure relates to a shade tarp using an advertising balloon, and has advantages in that as a cover portion is upward-movably installed on a frame that is lifted into the air by injecting gas into the frame, ventilation is possible between the frame and the cover portion and shade is provided under the frame through the cover portion that floats high in the air.

Also, the present disclosure has advantages in that as the cover portion is provided on the frame that is lifted into the air to provide shade, a space under the frame may be secured, and as the flow of air under the frame becomes smooth, cool shade may be provided.

Also, the present disclosure has advantages in that as the frame is formed to have a double structure, leakage of helium gas may be prevented, and as the cover portion is provided on the frame that is lifted into the air to provide shade, installation cost may be low.

BRIEF DESCRIPTION OF DRAWINGS

FIG. 12A illustrates a circular shape of a frame;

FIG. 12B illustrates a bell shape of a frame;

FIG. 12C illustrates a star shape of a frame; and

FIG. 12D illustrates a rectangular shape of a frame.

DETAILED DESCRIPTION OF EMBODIMENTS

Principles and embodiments of the present disclosure will be described in detail in order to fully convey the scope of the present disclosure and enable one of ordinary skill in the art to embody and practice the present disclosure. The embodiments may be implemented in various forms.

As used in various embodiments of the present disclosure, the expressions "include," "may include" and other conjugates refer to the existence of a corresponding disclosed function, operation, or constituent element, and do not limit one or more additional functions, operations, or constituent elements. Further, as used in various embodiments of the present disclosure, the terms "include," "have" and their conjugates may be construed to denote a certain feature, number, step, operation, constituent element, component, or a combination thereof, but may not be construed to exclude the existence of or a possibility of addition of one or more other features, numbers, steps, operations, constituent elements, components, or combinations thereof.

When a component is referred to as being "connected" or "combined" to any other component, it should be understood that the component may be directly connected or combined to the other component, but another new component may also be interposed between them. In contrast, when a component is referred to as being "directly connected" or "directly combined" to any other component, it should be understood that there is no new component between the component and the other component.

It will be understood that although the terms "first," "second," etc. may be used herein to describe various elements, these elements should not be limited by these terms. These terms are only used to distinguish one element from another.

The present disclosure relates to a shade tarp using an advertising balloon in which as a cover portion is upward-movably installed on a frame that is lifted into the air by injecting gas into the frame, ventilation is possible between the frame and the cover portion and shade is provided under the frame through the cover portion that floats high in the air. Hereinafter, preferred embodiments of the present disclosure will be described in detail with reference to the accompanying drawings.

Figure 1A:
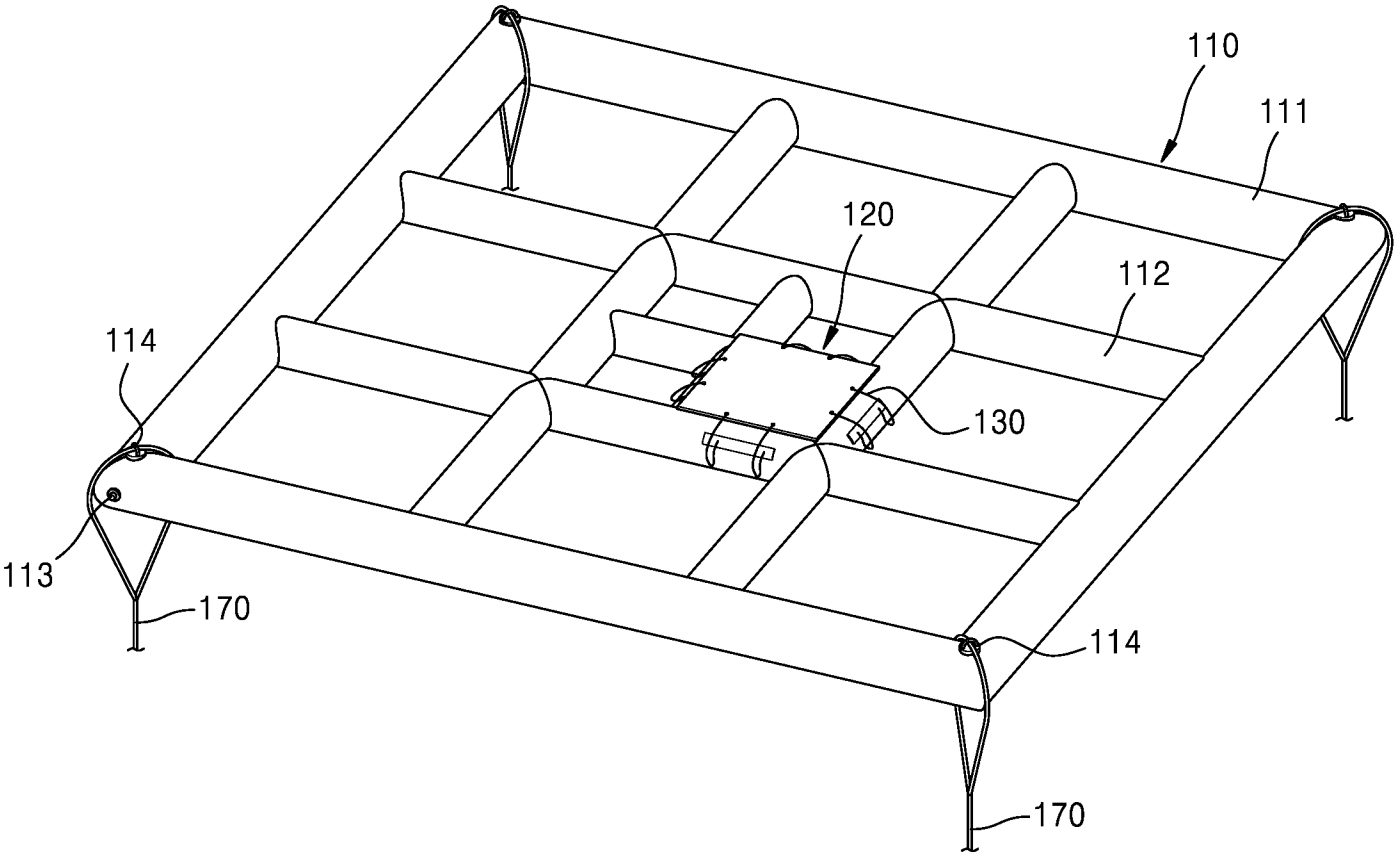
FIG. 1A is a view illustrating a shade tarp using an advertising balloon, according to an embodiment of the present disclosure.
Figure 1B:
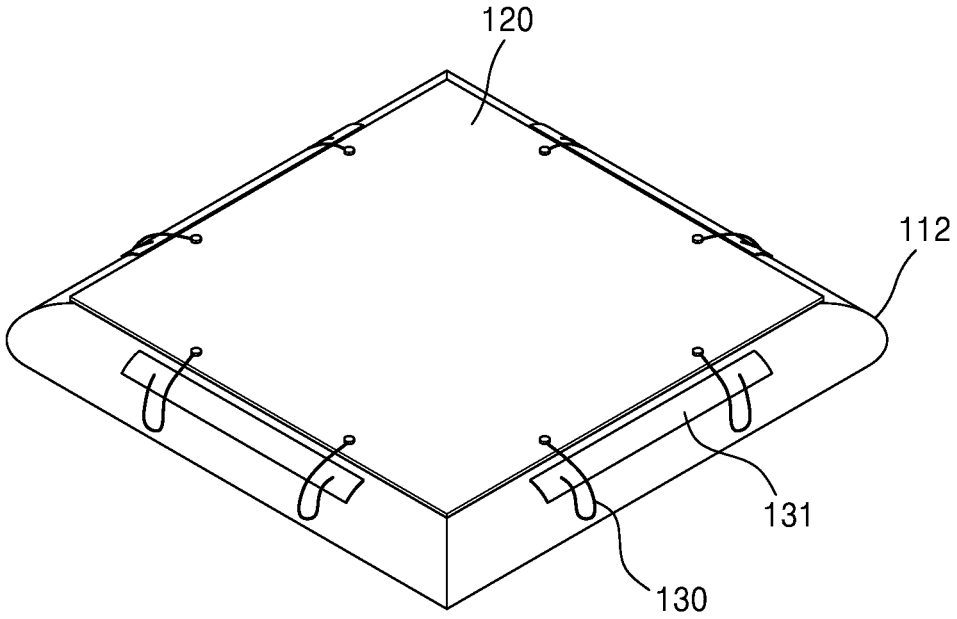
FIG. 1B is a partial enlarged view of FIG. 1A.
Figure 1C:
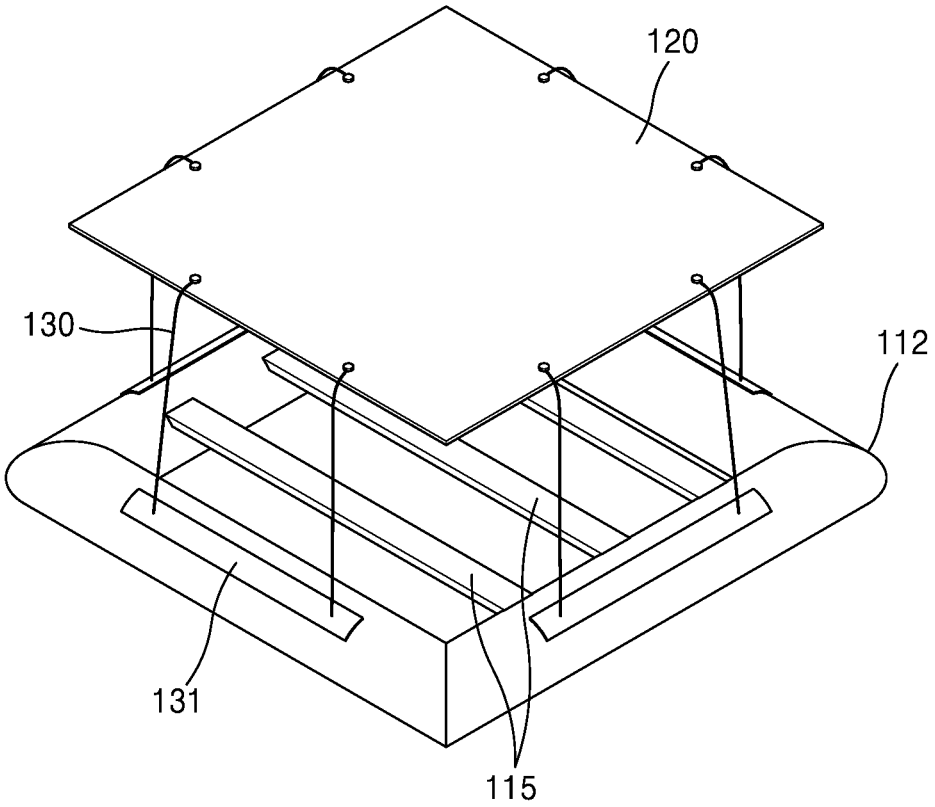
FIG. 1C is another partial enlarged view of FIG. 1A.

Referring to FIGS. 1A through 1C, a shade tarp using an advertising balloon according to an embodiment of the present disclosure includes a frame 110, a cover portion 120, and a connector 130.

The frame 110 includes an outer frame 111 into which gas is injected and an inner frame 112 that is provided inside the outer frame 111 and into which gas is injected. The frame 110 may be an advertising balloon into which gas is injected. The frame 110 includes the outer frame 111 that forms an outer structure and the inner frame 112 that is combined to the outer frame 111 to form a space inside the outer frame 111.

Gas injected into the frame 110 may be helium or hydrogen, but the present disclosure is not limited thereto. Any of various gases may be used as long as the gas may enable the frame 110 to be lifted into the air.

The frame 110 may have a quadrangular shape as shown in FIG. 1A and a lattice structure may be formed inside the frame 110. In detail, as the inner frame 112 is arranged in a lattice structure inside the outer frame 111, an inner space may be formed inside the frame 110.

As the inner space is formed inside the frame 110, air may pass through the inner space of the frame 110. An advertising balloon in the related art has problems in that because the advertising balloon does not have a passage through which air passes, when a size of the advertising balloon increases, a rope for fixing the advertising balloon may break or the advertising balloon may be damaged due to the pressure of the air.

In order to solve the problems, the shade tarp using the advertising balloon according to an embodiment of the present disclosure may allow the inner space to be formed inside the frame 110 so that air passes through the inner space. As air passes through the inner space of the frame 110, the pressure of the air applied to the frame 110 may be reduced, and thus damage to a rope for fixing the frame 110 or damage to the frame 110 itself may be prevented.

Although the frame 110 has a quadrangular shape in FIG. 1A, the present disclosure is not limited thereto. Referring to FIGS. 12A through 12D, the frame 110 may be manufactured in any of various shapes through the outer frame 111 that forms an outer structure of the frame 110 and the inner frame 112 that is installed inside the outer frame 111 to form an inner space.

In detail, the frame 110 may be formed in any of various shapes such as a wheel shape, a star shape, a seagull shape, or a curved quadrangular shape to have an inner space, and the frame 110 may be formed in a three-dimensional (3D) shape.

While the outer frame 111 may be a frame into which gas is injected, the inner frame 112 may be a frame into which gas is injected or gas is not injected.

The inner frame 112 may be a frame that inflates when gas is injected into the frame like the outer frame 111, or may be a frame that is formed of a cord or a string and into which gas is not injected.

Referring to FIG. 1A, a gas injection hole 113 for injecting gas into the frame 110 may be provided in the frame 110, and a rope fixing member 114 for fixing a rope 170 may be provided on the fame 110. The rope 170 may be inserted into the rope fixing member 114, and a side of the rope 170 is combined to a fixed point to fix the frame 110. A plurality of rope fixing members 114 may be provided, and the frame 110 may be fixed by using a plurality of ropes 170.

FIGS. 1B and 1C are views illustrating the cover portion 120 of FIG. 1A. Referring to FIGS. 1A, 1B, and 1C, the cover portion 120 may cover an inner space formed inside the frame 110. The cover portion 120 may cover a space formed by the outer frame 11 and the inner frame 112, and may cover a space formed between the inner frames 112. The cover portion 120 may be located at any of various points of the frame 110 according to a position of shade.

The cover portion 120 may be formed of an ultraviolet, infrared, or visible ray-blocking film, and may block sunlight to provide shade. In order to block ultraviolet, infrared, or visible rays, the cover portion 120 may be formed of an ultraviolet, infrared, or visible ray-blocking film, and or may be formed of a polyethylene film containing a transparent ultraviolet, infrared, or visible ray-blocking agent.

When the cover portion 120 is formed of a transparent film, the sky may be seen through the cover portion 120. Also, when the cover portion 120 is formed of a film, the frame 110 may be easily lifted into the air as a weight of the cover portion 120 decreases.

However, the cover portion 120 is not limited thereto, and the cover portion 120 may have any of various configurations as long as the cover portion 120 may block sunlight to provide shade. For example, the cover portion 120 may be formed of vinyl, cloth, or fabric.

As an inner space is formed inside the frame 110 and the cover portion 120 covers the inner space, a shade tarp may be formed while reducing a volume of the frame 110. In this case, as the cover portion 120 is formed of a light material, the frame 110 and the cover portion 120 may be lifted into the air even through gas injected into the frame 110. Also, as a volume of the frame 110 is reduced and the cover portion 120 is formed of a light material, the amount of used gas such as helium may be reduced.

The cover portion 120 may cover the inner space of the frame 110, and may be installed to be movable with respect to the frame 110. In detail, the cover portion 120 may be upward-movably installed on the frame 110. When wind blows, the cover portion 120 may move upward from the frame 110 due to the wind.

As the cover portion 120 moves upward from the frame 110, a space may be formed between the cover portion 120 and the frame 110 and air moves through the space, thereby leading to ventilation.

As described above, when a passage through which air passes is not formed in an advertising balloon, a rope for fixing the advertising balloon may break or the advertising balloon may be damaged due to the pressure of the air applied to the advertising balloon.

If a passage through which air passes is not formed when the cover portion 120 covers the inner space of the frame 110, the frame 110 or the cover portion 120 may be damaged by the pressure of the air, and the rope 170 for fixing the frame 110 may break.

However, because the cover portion 120 according to an embodiment of the present disclosure is upward-movably installed on the frame 110, air may move between the cover portion 120 and the frame 110. Accordingly, the pressure of the air applied to the cover portion 120 and the frame 110 may be reduced.

The connector 130 for connecting the cover portion 120 to the frame 110 may connect the cover portion 120 to the frame 110 so that the cover portion 120 is movable with respect to the frame 110.

Referring to FIGS. 1A, 1B, and 1C, the connector 130 may be formed of a string, and an end of the connector 130 may be connected to the cover portion 120 and the other end of the connector 130 may be connected to the frame 110.

A fabric portion 131 for connecting the other end of the connector 130 may be provided on the frame 110. The fabric portion 131 that is attached to the frame 110 through an adhesive may connect the other end of the connector 130 formed of a string to the fabric portion 131.

Assuming that the connector 130 is formed of a string, when wind blows to the cover portion 120, the cover portion 120 may move upward with respect to the frame 110, but the cover portion 120 may not be separated from the frame 110 due to the connector 130.

In detail, the cover portion 120 functions as a shade tarp by covering the inner space of the frame 110, and when wind blows upward, the cover portion 120 may be opened by a length of the connector 130 to allow air to pass and achieve ventilation.

However, the connector 130 is not limited to a string, and any of various devices may be used as long as the device may connect the cover portion 120 so that the cover portion 120 is movable with respect to the frame 110 and may prevent separation of the cover portion 120.

Figure 2A:
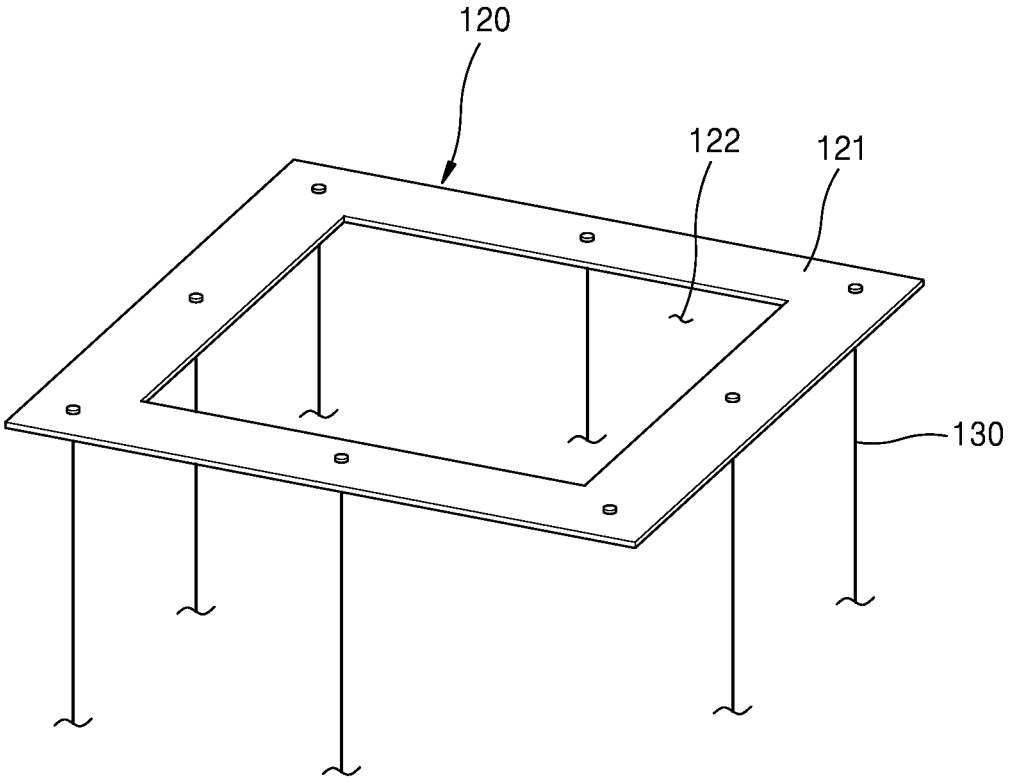
FIG. 2A illustrates a cover portion including an edge portion, according to an embodiment of the present disclosure.
Figure 2B:
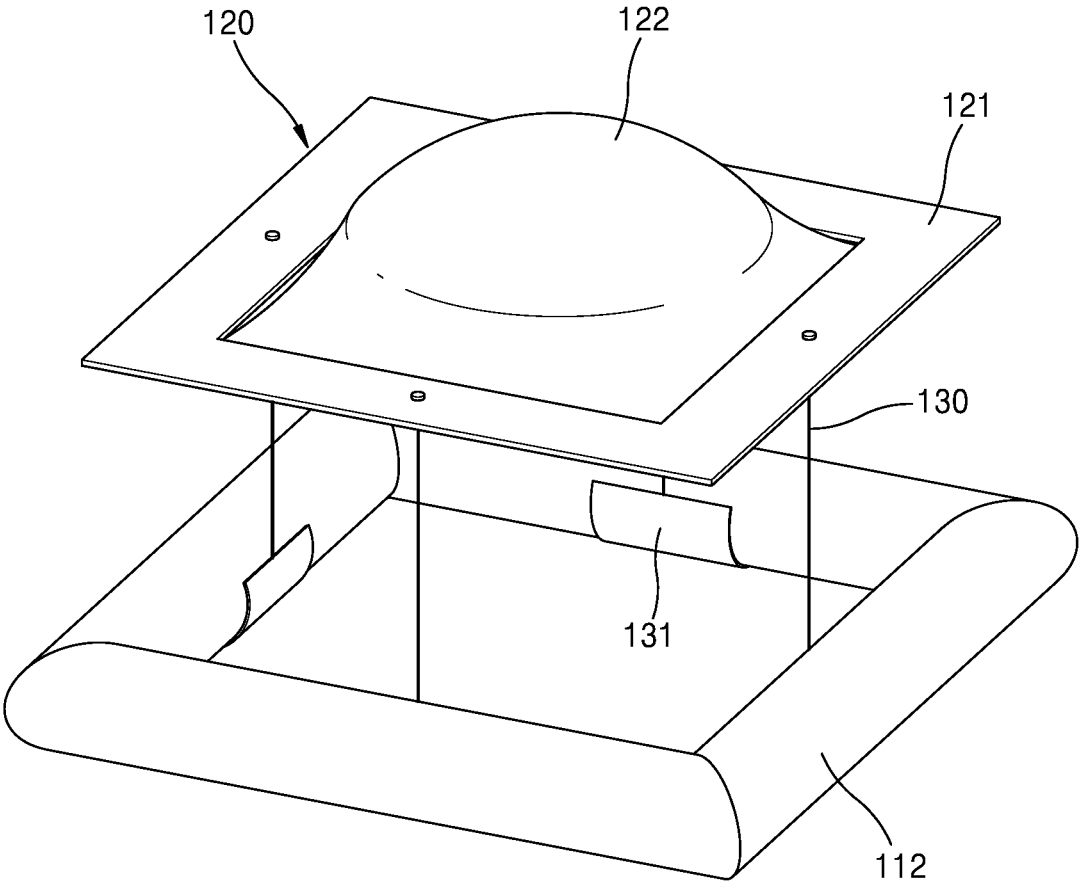
FIG. 2B illustrates a cover portion including a sun-shielding portion, according to an embodiment of the present disclosure.

Referring to FIGS. 2A and 2B, the cover portion 120 may include an edge portion 121 to which the connector 130 is combined, and a sun-shielding portion 122 provided inside the edge portion 121.

The edge portion 121 is a portion for connecting the connector 130, and the sun-shielding portion 122 is a portion for forming a shade tarp. The edge portion 121 may be formed of a material having higher rigidity than that of a film to fix the connector 130. The sun-shielding portion 122 may be formed of an ultraviolet, infrared, or visible ray-blocking film, and gas may be injected into the sun-shielding portion 122.

The sun-shielding portion 122 may inflate when gas is injected into the sun-shielding portion 122, and gas such as helium or hydrogen may be injected into the sun-shielding portion 122. When gas is injected into the sun-shielding portion 122, the cover portion 122 may be easily moved even with a small pressure of air.

When the cover portion 120 is formed of a film, the cover portion 120 may be easily torn by the pressure of air or vertical movement of the cover portion 120. However, when the cover portion 120 includes the edge portion 121 formed of a material having higher rigidity than that of the film, the film may be prevented from being torn due to the edge portion 121.

Referring to FIGS. 1B, 1C, 3A, and 3B, in an inner space formed inside the frame 110, a base support 115 having an end and the other end combined to the frame 110 may be provided.

The base support 115 that is provided in the inner space of the frame 110 may be provided in a space formed by the outer frame 111 and the inner frame 112 or a space formed between the inner frames 112.

The base support 115 may support the cover portion 120 while preventing the cover portion 120 from sagging into the inner space of the frame 110 due to gravity. The base support 115 may extend so that the end and the other end are combined to the frame 110. The base support 115 may be combined to the frame 110 through an adhesive or may be integrally formed with the frame 110.

It is preferable that in order to support the cover portion 120 while preventing the cover portion 120 from sagging, one end and the other end of the base support 115 are combined to an upper portion of the frame 110.

However, the present disclosure is not limited thereto, and the end and the other end of the base support 115 may be combined to any one point of an upper portion, a middle portion, and a lower portion of the frame 110. The upper portion, the middle portion, and the lower portion of the frame 110 are points distinguished according to a height direction of the frame 110.

Figure 3A:
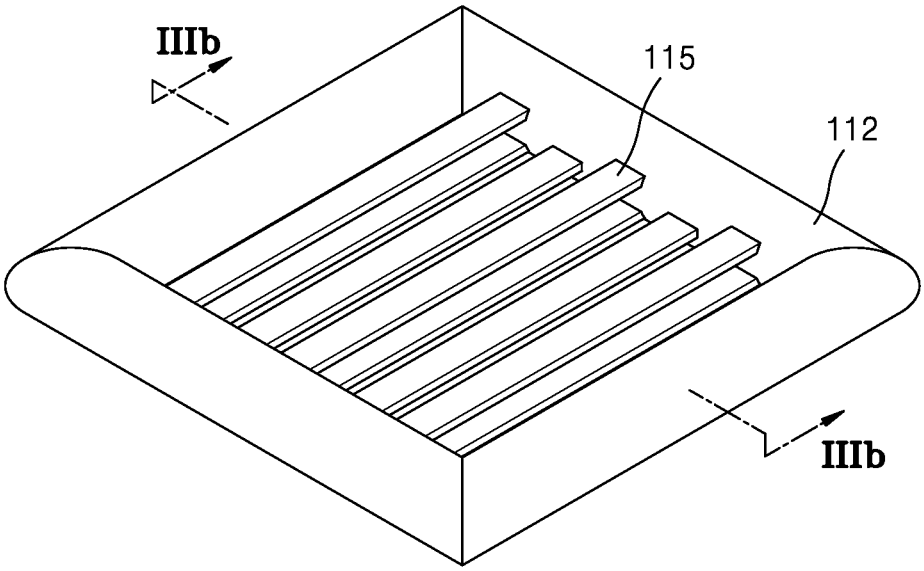
FIG. 3A is a view illustrating that a plurality base supports are provided in an inner space of a frame, according to an embodiment of the present disclosure.
Figure 3B:
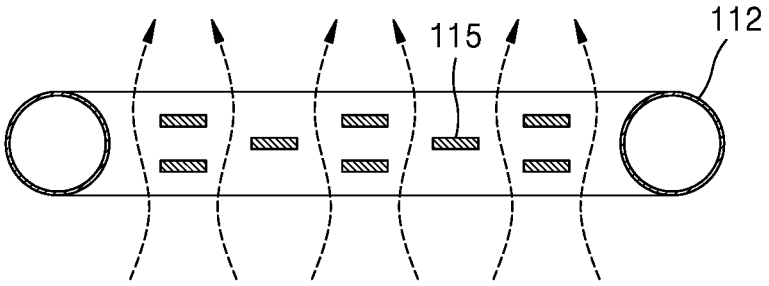
FIG. 3B is a cross-sectional view taken along line A-A of FIG. 3A.

In detail, referring to FIGS. 3A and 3B, a plurality of base supports 115 may be combined in an inner space formed inside the frame 110. In this case, one end and the other end of each of the plurality of base supports 115 may be combined to any one point of the upper portion, the middle portion, and the lower portion of the frame 110.

When the plurality of base supports 115 are installed in the inner space of the frame 110, the inner space of the frame 110 should not be blocked by the plurality of base supports 115.

Accordingly, it is preferable that when the plurality of base supports 115 are installed in the inner space of the frame 110, the ends and the other ends of the plurality of base supports 115 are alternately installed at the upper portion, the middle portion, and the lower portion of the frame 110 to form a space between the base supports 115.

Also, a shade tarp may be formed through the plurality of base supports 115. The base supports 115 may be combined to the frame 110 to cover the inner space of the frame 110, and the base supports 115 adjacent to both sides of one base support 115 may be combined to the frame 110 at a height different from that the one base support 115.

That is, when one base support 115 is combined to the upper portion of the frame 110, base supports adjacent to both sides of the one base support 115 may be combined to either the lower portion or the middle portion, not the upper portion of the frame 110. When the plurality of base supports 115 are combined to the frame 110 in this way, shade may be provided through the plurality of base supports 115 and air may pass through between the plurality of base supports 115.

The base support 115 may have a bar shape while gas is injected into the base support 115, or may be integrally formed with the frame 110. Also, an edge injection hole through which gas is injected may be formed in a side surface of the base support 115.

Although the base support 115 may have a bar shape having one end and the other end combined to the frame 110, the present disclosure is not limited thereto. The base support 115 may be formed of a safety net for supporting the cover portion 120 inside the frame 110.

Figure 2C:
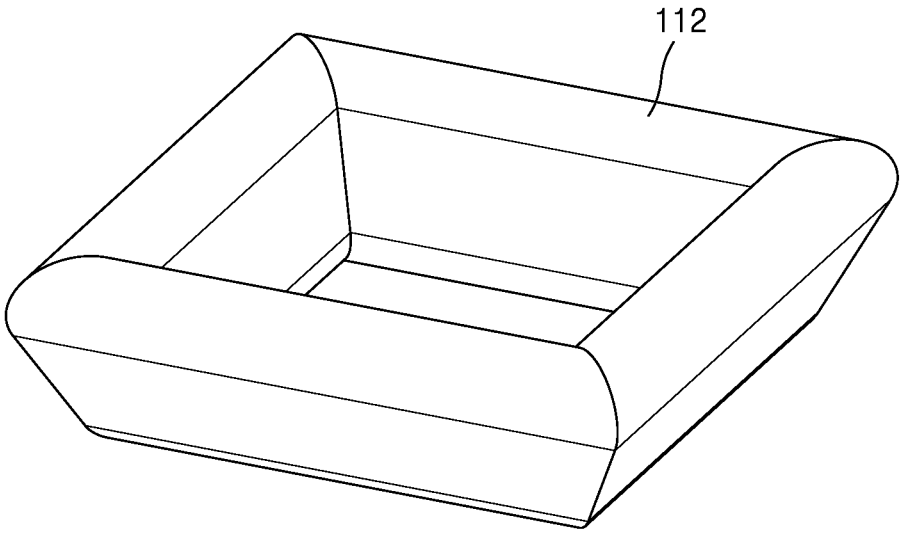
FIG. 2C is a view illustrating an inner frame having a trapezoidal cross-sectional shape, according to an embodiment of the present disclosure.

Referring to FIG. 2C, the frame 110 may be formed to have a wide upper portion and a narrow lower portion. In detail, a cross-sectional shape of the frame 110 may be a trapezoidal shape with a wide upper portion. Assuming that the frame 110 has a wide upper portion and a narrow lower portion, when the frame 120 is lifted by air and then is lowered, the cover portion 120 may be easily seated at an initial position on the frame 110.

Figure 4A:
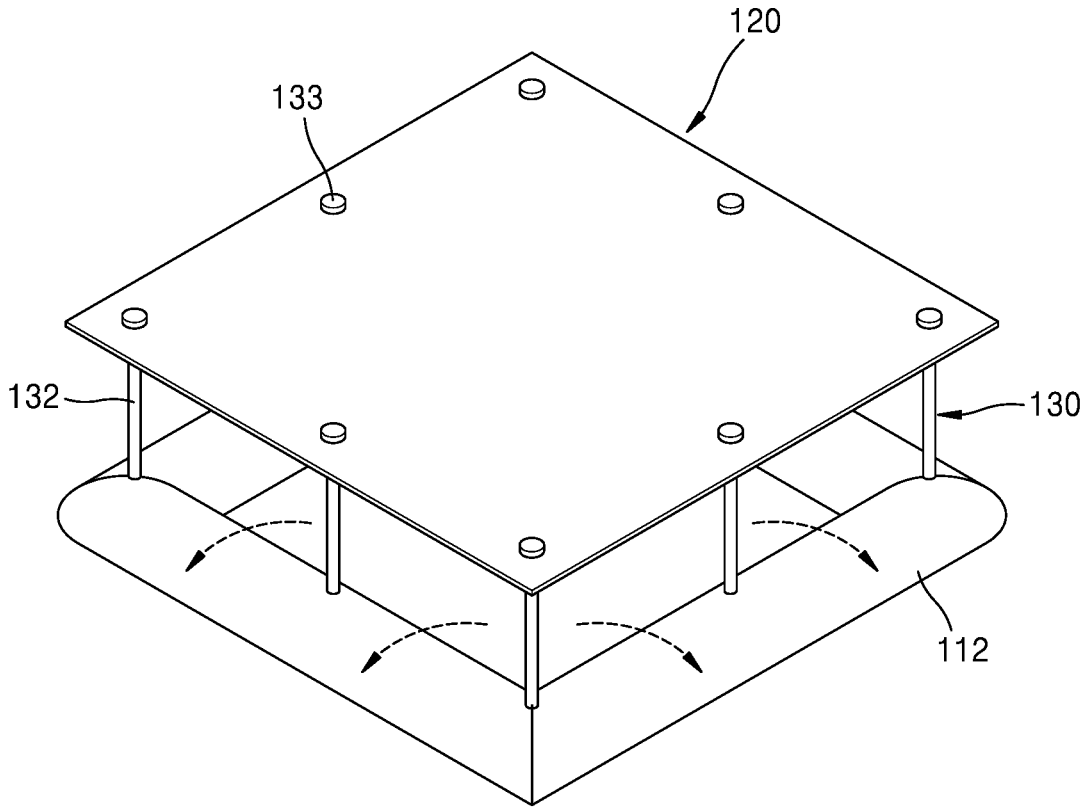
FIG. 4A is a view illustrating a connector including a movable portion and a lid portion, according to an embodiment of the present disclosure.
Figure 4B:
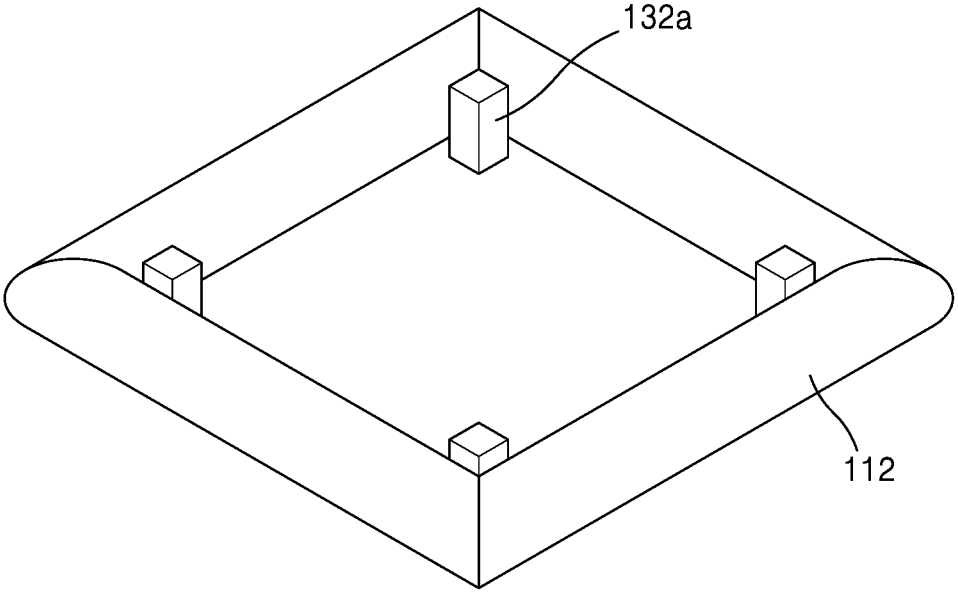
FIG. 4B is a view illustrating that a movable portion housing is provided inside a frame.
Figure 4C:
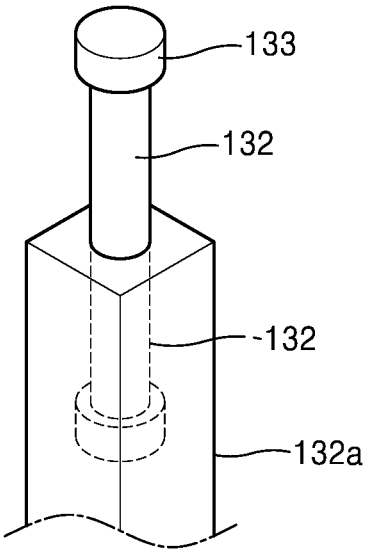
FIG. 4C is a view illustrating that the movable portion is inserted into the movable portion housing and slides.

Referring to FIGS. 4A, 4B, and 4C, the connector 130 according to another embodiment of the present disclosure may include a movable portion 132 having a bar shape combined to protrude toward an upper portion of the frame 110 and a lid portion 133 provided on an end of the movable portion 132.

The connector 130 may have a base support shape, instead of a string. A plurality of connectors 130 may be provided, and a plurality of connection holes 123 into which the movable portions 132 of the connectors 130 may be inserted may be formed in the cover portion 120.

When the movable portions 132 are inserted into the connection holes 132 of the cover portion 120 and then the lid portions 133 are combined to the movable portions 132, separation of the cover portion 120 may be prevented. The lid portion 133 may have a width and a diameter greater than those of the connection hole 123, and may be formed of rubber, a plastic lid, or a fixing pin.

Although the movable portion 132 may be combined to a top surface of the frame 110 or an inner surface of the frame 110, it is preferable that the movable portion 132 is combined to the inner surface of the frame 110.

In detail, the movable portion 132 may be combined to the inner surface of the frame 110 through a movable portion housing 132*a* having a rectangular cube shape, and the movable portion 132 may be inserted into the movable portion housing 132 to vertically slide.

When wind blows to the cover portion 120, the movable portion 132 may vertically slide and the cover portion 120 may vertically move, and thus air may move through a space between the cover portion 120 and the frame 110. The cover portion 120 may be fixedly fitted to an upper portion of the movable portion 132.

Also, the movable portion 132 may be combined to protrude toward the frame 110 but may not be slidable, and the cover portion 120 fitted to the movable portion 132 may vertically move while sliding inside the movable portion 132.

The movable portion 132 may be combined to protrude toward the frame 110 and may not be slidable, and the cover portion 120 may be fixedly combined to the upper portion of the movable portion 132 so that a space between the cover portion 120 and the frame 110 is always open.

Figure 5A:
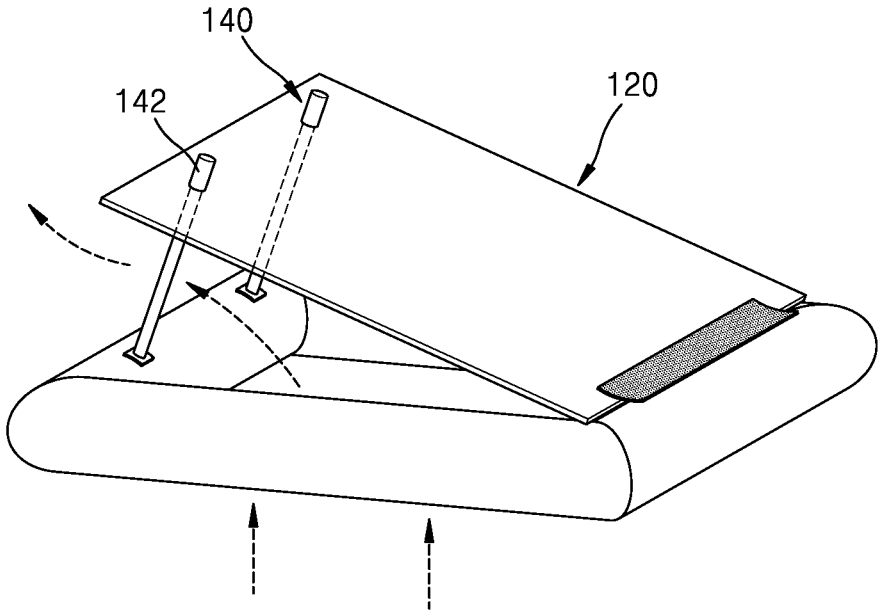
FIG. 5A illustrates that a side of a cover portion is movably combined to a frame through a first connector, according to an embodiment of the present disclosure.
Figure 5B:
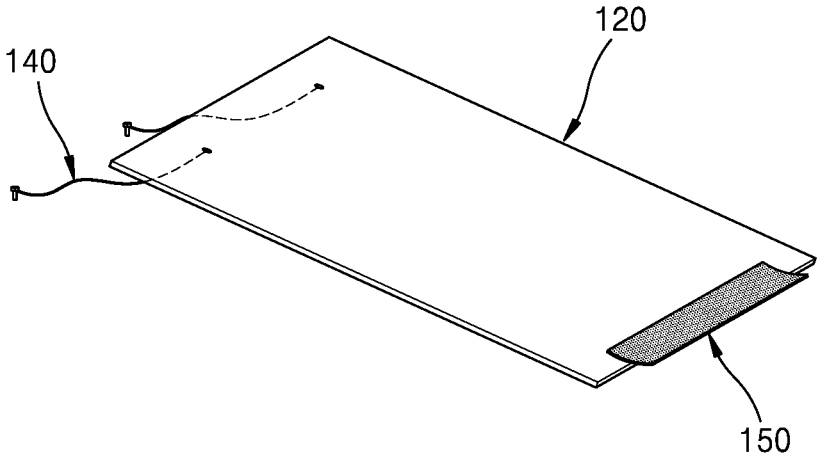
FIG. 5B illustrates that the other side of the cover portion is fixedly combined to the frame through a second connector, according to an embodiment of the present disclosure.

Referring to FIGS. 5A and 5B, the connector 130 may include a first connector 140 that connects a side of the cover portion 120 to the frame 110 so that the side of the cover portion 120 is movable upward with respect to the frame 110, and a second connector 150 that connects the other side of the cover portion 120 to the frame 110 so that the other side of the cover portion 120 is fixedly combined to the frame 110 so as not to be movable upward.

As the other side of the cover portion 120 is hinged to the frame 110, the side of the cover portion 120 may rotate about the other side of the cover portion 120 to open the cover portion 120.

The first connector 140 may connect the cover portion 120 to a side of the frame 110, and may include a first movable portion 141 having a bar shape combined to protrude toward an upper portion of the frame 110 and a first lid portion 142 provided on an end of the first movable portion 141. The first movable portion 141 and the first lid portion 142 may correspond to the movable portion 132 and the lid portion 133, and thus a detailed description thereof will be omitted.

The first movable portion 141 may extend in an upward oblique direction with respect to the frame 110. Because the other side of the cover portion 120 connected by the second connector 150 is fixed to the frame 110 and the side of the cover portion 120 connected by the first connector 140 rotates to open the cover portion 120 as described above, the cover portion 120 is opened obliquely, instead of linearly.

The cover portion 120 may be opened along the first movable portion 141. As the first movable portion 141 extends in an upward oblique direction parallel to a direction in which the cover portion 120 is opened, the cover portion 120 may easily move.

Although the first connector 140 includes the first movable portion 141 and the first lid portion 142, the first connector 140 is not limited thereto. As shown in FIG. 5B, the first connector 140 may be formed of a string or a rubber band.

Figure 5C:
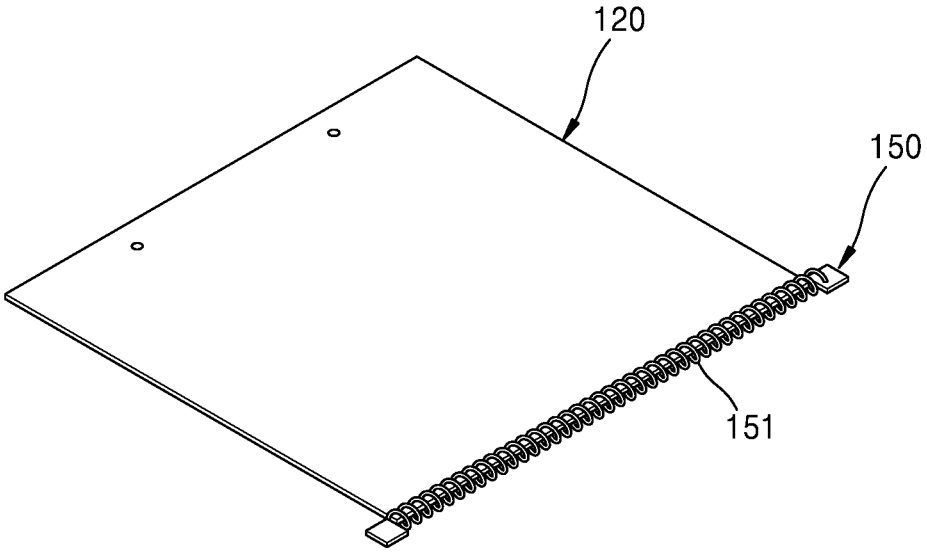
FIG. 5C is a view illustrating that a spring is provided on the second connector, according to an embodiment of the present disclosure.

Referring to FIG. 5C, the second connector 150 connects the cover portion 120 to the frame 110 so that the other side of the cover portion 120 is not moved. The second connector 150 fixedly combines the other side of the cover portion 120 to the frame 110 so that the other side of the cover portion 120 is not opened, and the cover portion 120 may rotate about the second connector 150.

Also, a spring 151 may be provided in the second connector 150. Assuming that the spring 151 is provided in the second connector 150, after wind blows and the cover portion 120 is lifted, the cover portion 120 may easily return to its initial position due to the force of the spring 151. The spring 151 may be formed of a frame into which gas is injected, or may be formed as a spring into which gas is not injected.

Figure 6:
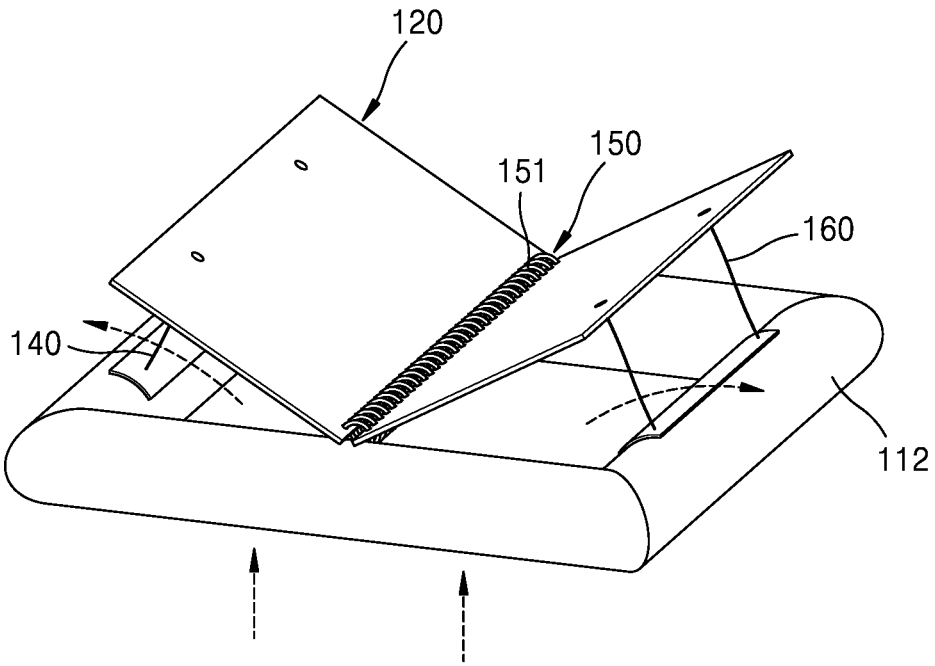
FIG. 6 is a view illustrating that a side and the other side of a cover portion are movably combined to a frame through a first connector and a third connector, and a middle portion of the cover portion is fixedly combined to the frame through a second connector, according to an embodiment of the present disclosure.

Referring to FIG. 6, the connector 130 according to another embodiment of the present disclosure may include the first connector 140 that connects a side of the cover portion 120 to the frame 110 so that the side of the cover portion 120 is movable upward with respect to the frame 110, the second connector 120 that connects a middle portion of the cover portion 120 to the frame 110, while the middle portion of the cover portion 120 is fixedly combined to the frame 110 so that the middle portion of the cover portion 120 is not movable upward with respect to the frame 110, and a third connector 160 that connects the other side of the cover portion 120 to the frame 110 so that the other side of the cover portion 120 is movable upward with respect to the frame 110.

According to an embodiment of FIG. 6, the middle portion of the cover portion 120 may be fixed, and both sides of the cover portion 120 may rotate about the middle portion of the cover portion 120 to be opened.

The first connector 140 may connect the cover portion 120 to a side of the frame 110, and may include the first movable portion 141 that has a bar shape combined to protrude toward an upper portion of the frame 110 and the first lid portion 142 that is provided on an end of the first movable portion 141. The first movable portion 141 and the first lid portion 142 may correspond to the movable portion 132 and the lid portion 133, and thus a detailed description thereof will be omitted.

The first movable portion 141 may extend in an upward oblique direction with respect to the frame 110. Because the middle portion of the cover portion 120 connected by the second connector 150 is fixed and the side of the cover portion 120 connected by the first connector 140 rotates to open the cover portion 120 as described above, the cover portion 120 is opened obliquely, instead of linearly.

The cover portion 120 may be opened along the first movable portion 141. As the first movable portion 141 extends in an upward oblique direction parallel to a direction in which the cover portion 120 is opened, the cover portion 120 may easily move.

Although the first connector 140 includes the first movable portion 141 and the first lid portion 142, the first connector 140 is not limited thereto. The first connector 140 may be formed of a string or a rubber band.

The third connector 160 may connect the cover portion 120 to the other side of the frame 110, and may include a third movable portion having a bar shape combined to protrude toward the upper portion of the frame 110 and a third lid portion provided on an end of the third movable portion. The third movable portion and the third lid portion correspond to the movable portion 132 and the lid portion 133, and thus a detailed description thereof will be omitted.

The third movable portion may extend in an upward oblique direction with respect to the frame 110. Because the middle portion of the cover portion 120 connected by the second connector 150 is fixed and the side of the cover portion 120 connected by the third connector 160 rotates to open the cover portion 120 as described above, the cover portion 120 is opened obliquely, instead of linearly.

The cover portion 120 may be opened along the third movable portion. As the third movable portion extends in an upward oblique direction parallel to a direction in which the cover portion 120 is opened, the cover portion 120 may easily move.

Although the third connector 160 includes the third movable portion and the third lid portion, the third connector 160 is not limited thereto. The third connector 160 may be formed of a string or a rubber band.

The second connector 150 connects the cover portion 120 to the frame 110 so that the middle portion of the cover portion 120 does not move. The second connector 150 fixedly combines the middle portion of the cover portion 120 to the frame 110 so that the middle portion of the cover portion 120 does not move, and the cover portion 120 may rotate about the second connector 150 to open the side and the other side of the cover portion 120.

Also, the spring 151 may be provided in the second connector 150. Assuming that the spring 151 is provided in the second connector 150, after wind blows and the cover portion 120 is lifted, the cover portion 120 may easily return to its initial position due to the force of the spring 151.

Figure 7A:
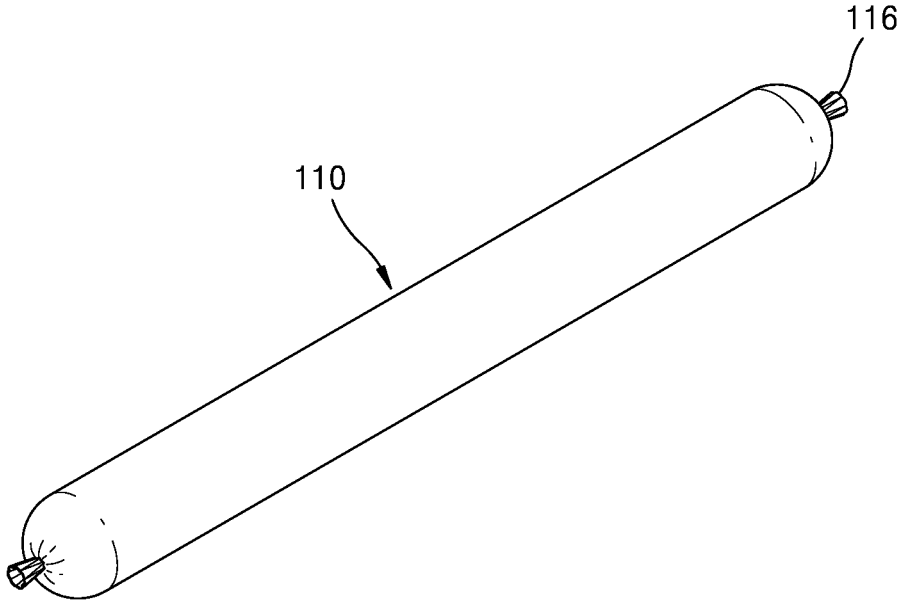
FIG. 7A is a view illustrating that a twisted portion is provided on a frame, according to an embodiment of the present disclosure.
Figure 7B:
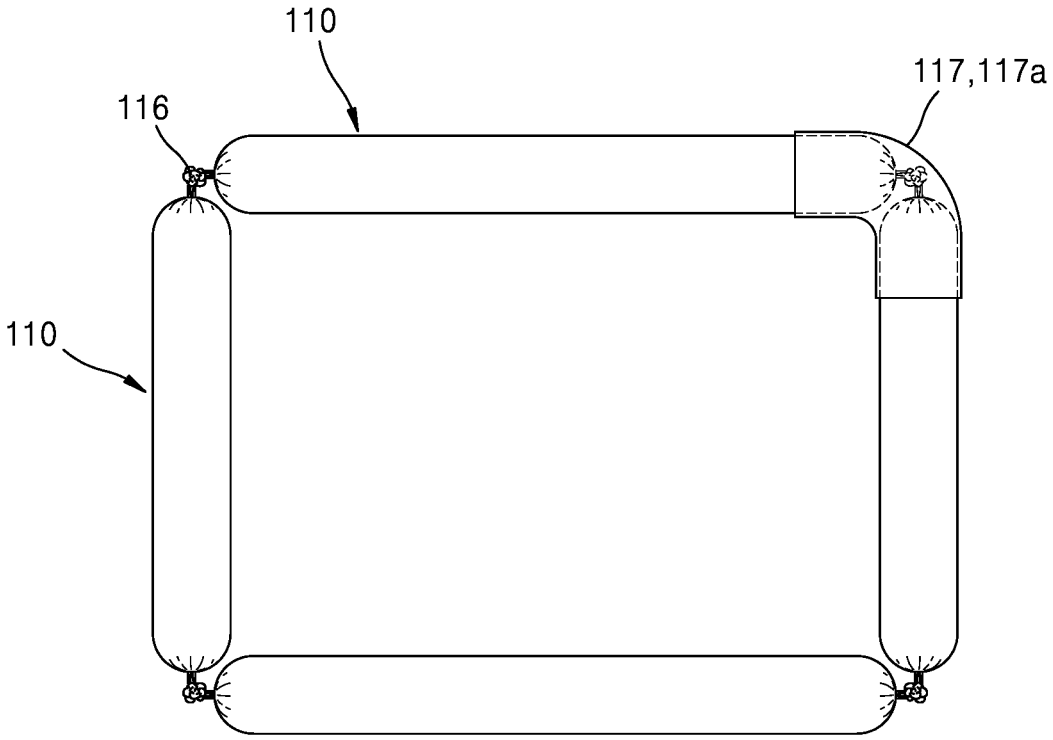
FIG. 7B illustrates an L-shaped fixing cover provided on the frame, according to an embodiment of the present disclosure.
Figure 7C:
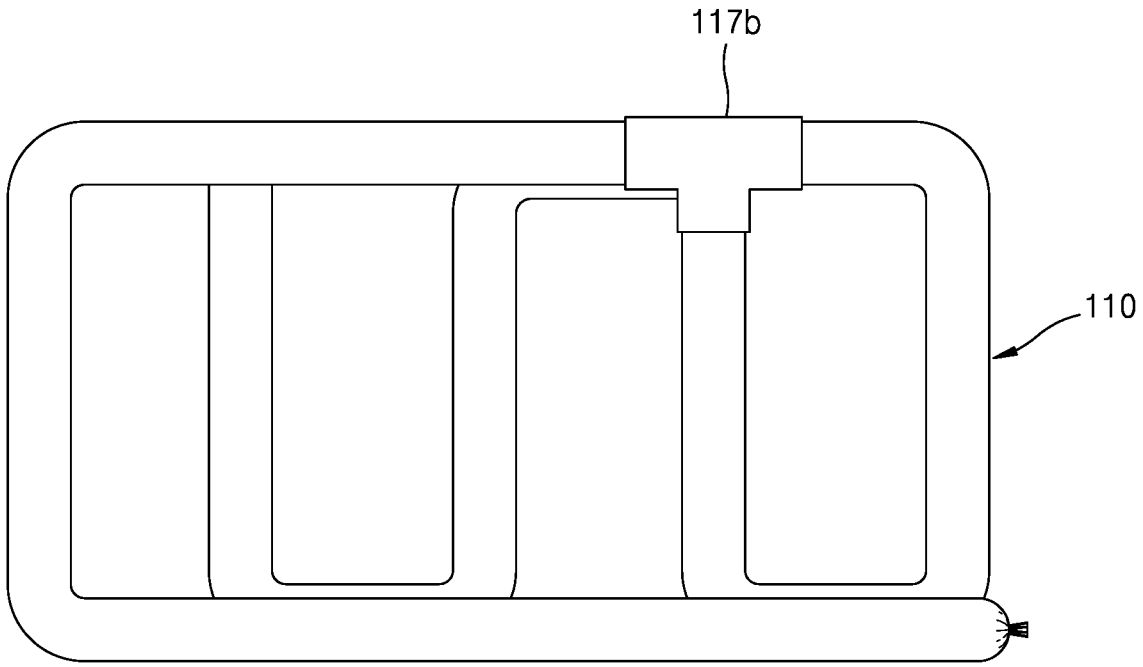
FIG. 7C illustrates that a T-shaped fixing cover is provided on the frame, according to an embodiment of the present disclosure.

Referring to FIGS. 7A through 7C, the frame 110 may have a cylindrical shape, and includes a twisted portion 116 in which the frame 110 having the cylindrical shape is twisted. Any of various shapes may be implemented through the frame 110, and to this end, various points of the frame 110 should be bent.

In the case of an advertising balloon in the related art, when the advertising balloon is manufactured in a desired shape by using an adhesive, gas may leak from an adhered portion and thus gas should be periodically replenished However, in the case of the frame 110 according to an embodiment of the present disclosure, the frame 110 may be manufactured in a desired shape by twisting the frame 110 having a cylindrical shape.

In detail, as shown in FIG. 7B, the twisted portion 116 may be formed at a portion where the frame 110 is bent, and as the twisted portion 116 is formed, the frame 110 may be manufactured in any of various shapes.

It is preferable that the twisted portion 116 is twisted two to three times. When the twisted portion 116 is twisted less than twice, the frame 110 is not easily bent due to gas pressure inside the frame 110.

Also, when the twisted portion 116 is twisted more than three times, gas does not move through the twisted portion 116. In order to float the frame 110 in the air, when gas is injected into the frame 110 through the gas injection hole 113, the gas should be supplied to all points of the frame 110.

In this case, gas may move to all points of the frame 110 only when the gas finely moves even through the twisted portion 116. When the twisted portion 116 is twisted more than three times, gas may not move through the twisted portion 116, thereby failing to supply the gas to all points of the frame 110. Accordingly, it is preferable that the twisted portion 116 is twisted only two to three times.

Referring to FIGS. 7B and 7C, a fixing cover 117 may be combined to the twisted portion 116, and the fixing cover 117 may have any one of an L-shape 117*a*, a T-shape 117*b*, and a cross shape 117*c*. When the frame 110 is bent through the twisted portion 116, a shape of the frame 110 may be maintained only when the twisted portion 116 is prevented from being untwisted.

The fixing cover 117 may be combined to the twisted portion 116 to prevent the twisted portion 116 from being untwisted. The fixing cover 117 may have any of various shapes according to a shape of the frame 110, and may have any one of the L-shape 117*a*, the T-shape 117*b*, and the cross shape 117*c*. (In this case, the fixing covers 170 having the L-shape 117*a*, the T-shape 117*b*, and the cross shape 117*c* are bent at unequal angels inside the fixing covers 170.) Also, a thin string or rope may be combined to the twisted portion 116, and thus the twisted portion 160 may be prevented from being untwisted.

Figure 8A:
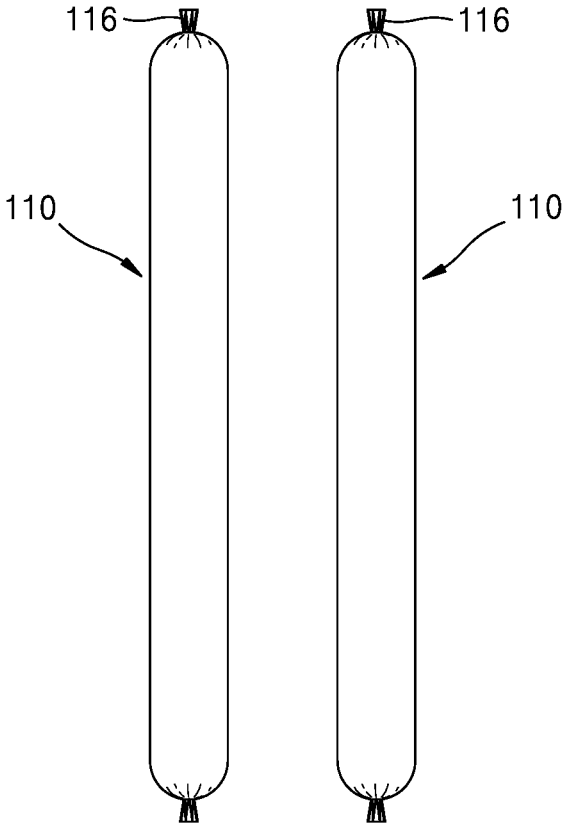
FIG. 8A is a view illustrating a plurality of frames provided with twisted portions, according to an embodiment of the present disclosure.
Figure 8B:
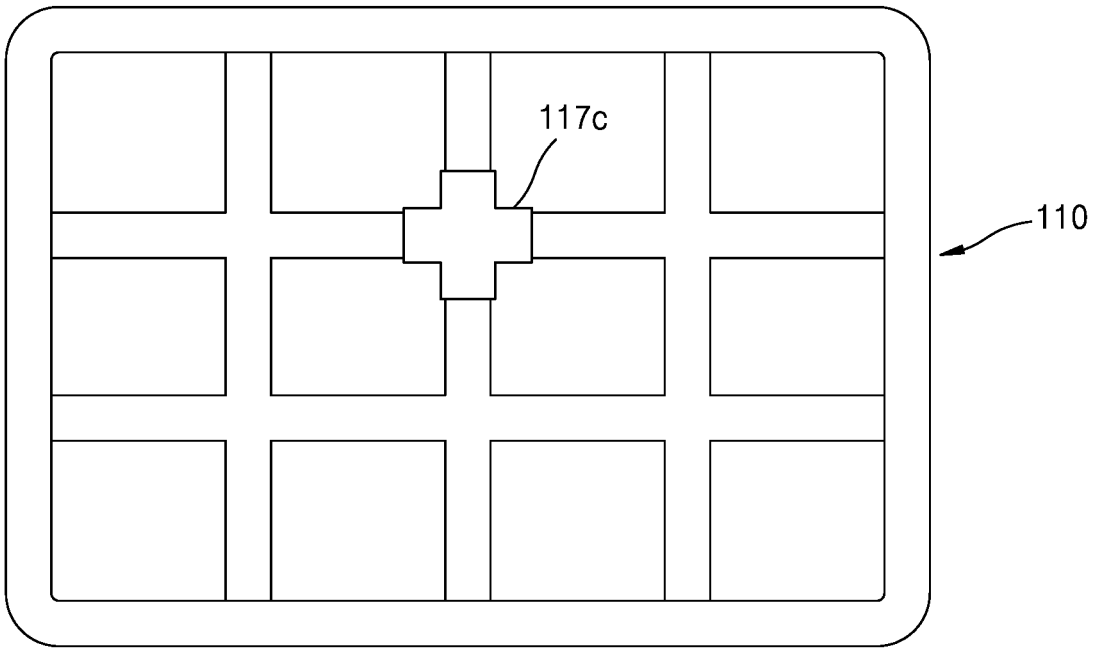
FIG. 8B is a view illustrating that the plurality of frames are combined through a cross-shaped fixing cover.

Also, referring to FIGS. 8A and 8B, a plurality of frames 110 each having a short cylindrical shape may be provided, and a shape of the frames 110 may be implemented by combining the plurality of frames 110 to the fixing cover having the L-shape 117*a*, the T-shape 117*b*, or the cross shape 117*c*.

The rope fixing member 114 may be provided in the frame 110 according to an embodiment of the present disclosure, and the rope 170 may be inserted into the rope fixing member 114. The rope 170 may be connected to four corners of the frame 110 to fix the frame 110.

Figure 9A:
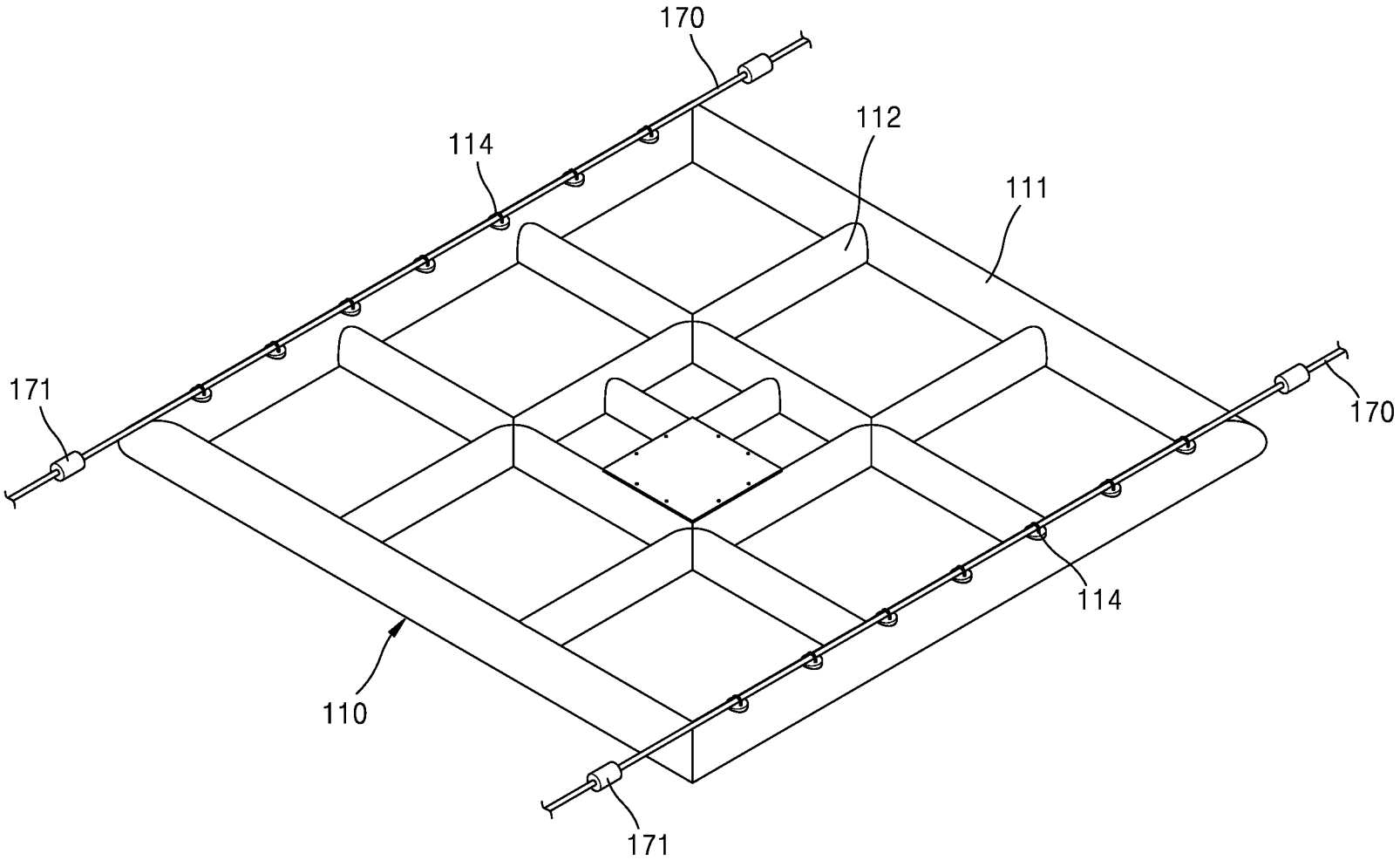
FIG. 9A is a view illustrating that ropes are combined to both side surfaces of a frame and a moving fixing portion is provided on each of the ropes, according to an embodiment of the present disclosure.

Referring to FIG. 9A, the frame 110 may include a plurality of rope fixing members 114, and the rope 170 may be inserted into the plurality of rope fixing members 114 along a side surface of the frame 110. The rope 170 may be of a steel wire, and may extend along both sides of the frame 110 to fix the frame 110.

A moving fixing portion 171 that does not pass through the rope fixing member 114 may be provided on the rope 170. The moving fixing portion 171 may be a stopper knot of the rope 170, and a fixing pin or a thin string may be combined to the stopper knot.

As the moving fixing portion 171 that does not pass through the rope fixing member 114 is installed on the rope 170, the frame 110 may be prevented from moving along the rope 170 or may cause the frame 110 to move only in a limited space.

Although the moving fixing portion 171 is a stopper knot, the present disclosure is not limited thereto. The moving fixing portion 171 may have any of various configurations as long as the moving fixing portion 171 may not pass through the rope fixing member 114 and thus may prevent movement of the frame 110.

Also, the frame 110 may be connected to the rope 170 through a thin string, and thus the frame 110 may be combined to the rope 170 in a state where the frame 110 is separated from the rope 170 and floats in the air.

Figure 9B:
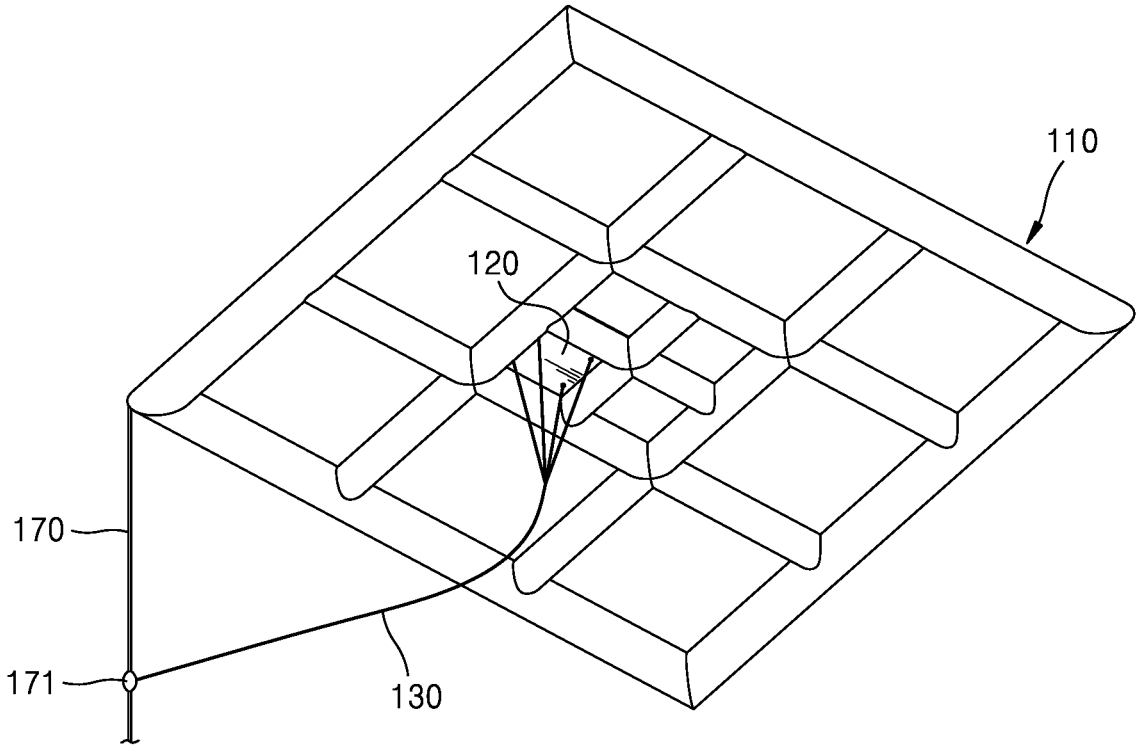
FIG. 9B is a view illustrating the rope and a cover portion are connected to each other through a connector, according to an embodiment of the present disclosure.

Referring to FIG. 9B, the rope 170 may extend below the frame 110, and the connector 130 may connect the cover portion 120 to the rope 170 so that the cover portion 120 is movable with respect to the frame 110.

The connector 130 may connect the cover portion 120 to the frame 110 so that the cover portion 120 is movable with respect to the frame 110 through the rope 170.

Referring to FIG. 9B, the cover portion 120 may move above the frame 110 due to wind, and because the cover portion 120 is connected to the rope 170 through the connector 130, separation of the cover portion 120 may be prevented.

The moving fixing portion 171 such as a stopper knot for limiting movement of the connector 130 may be provided on the rope 170, and movement of the connector 130 may be limited by the moving fixing portion 171. As movement of the connector 130 is limited, a distance by which the cover portion 120 moves with respect to the frame 110 due to wind may be limited.

Figure 10A:
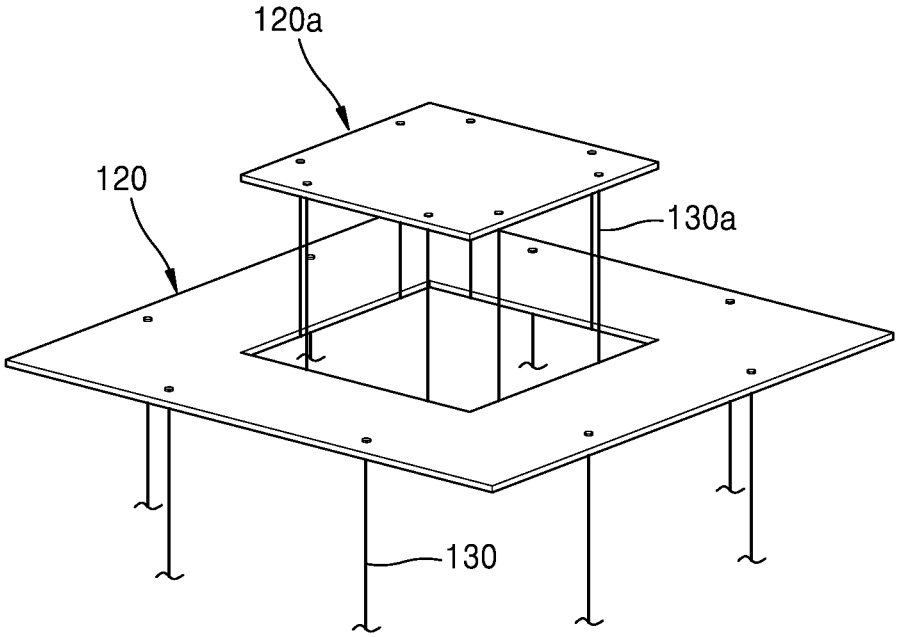
FIG. 10A illustrates a cover portion including a plurality of layers, according to an embodiment of the present disclosure.
Figure 10B:
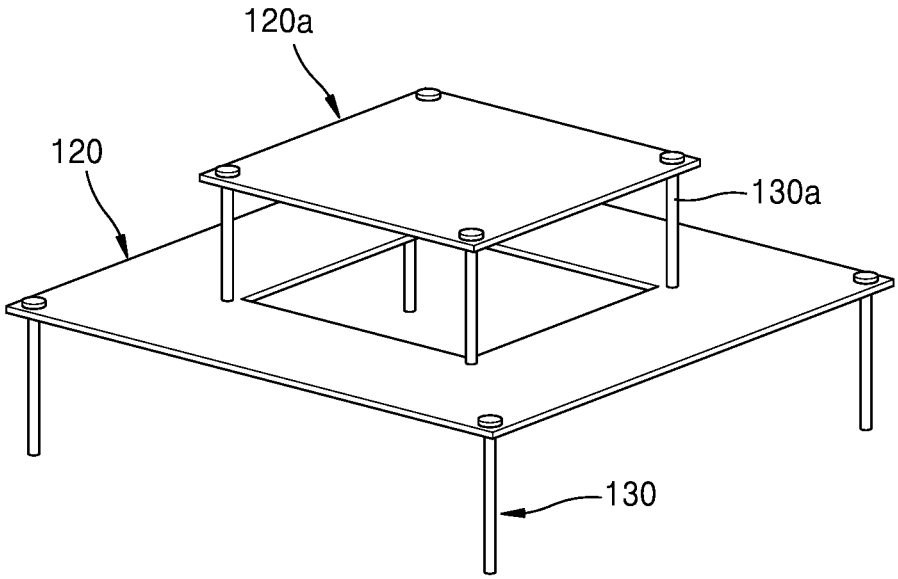
FIG. 10B illustrates another cover portion including a plurality of layers, according to an embodiment of the present disclosure.

Referring to FIGS. 10A and 10B, the cover portion 120 according to an embodiment of the present disclosure may include a plurality of layers. In detail, the cover portion 120 may include a second cover portion 120*a* formed over one layer. The second cover portion 120*a* may be connected to the cover portion 120, which is located below the second cover portion 120*a*, through a layer connector 130*a*.

In detail, an empty space may be formed on a lower layer of the cover portion 120, and the second cover portion 120*a* may cover the empty space. The second cover portion 120*a* is movable with respect to the lower layer of the cover portion 120, and the lower layer of the cover portion 120 and the second cover portion 120*a* may be connected to each other through the layer connector 130*a*.

The layer connector 130*a* may correspond to the connector 130, and thus configurations and characteristics used for the connector 130 may be applied to the layer connector 130. The layer connector 130*a* may be the same as the connector 130 except that the layer connector 130*a* connects the lower layer of the cover portion 120 to the second cover portion 120*a* and the connector 130 connects the frame 110 to the cover portion 120.

For example, the layer connector 130*a* may be formed of a string like the connector 130, and may include a movable portion having a bar shape and a lid portion as shown in FIG. 10B.

Although the cover portion 120 includes two layers in the above description, the present disclosure is not limited thereto, and the cover portion 120 may include three or more layers.

Figure 11:
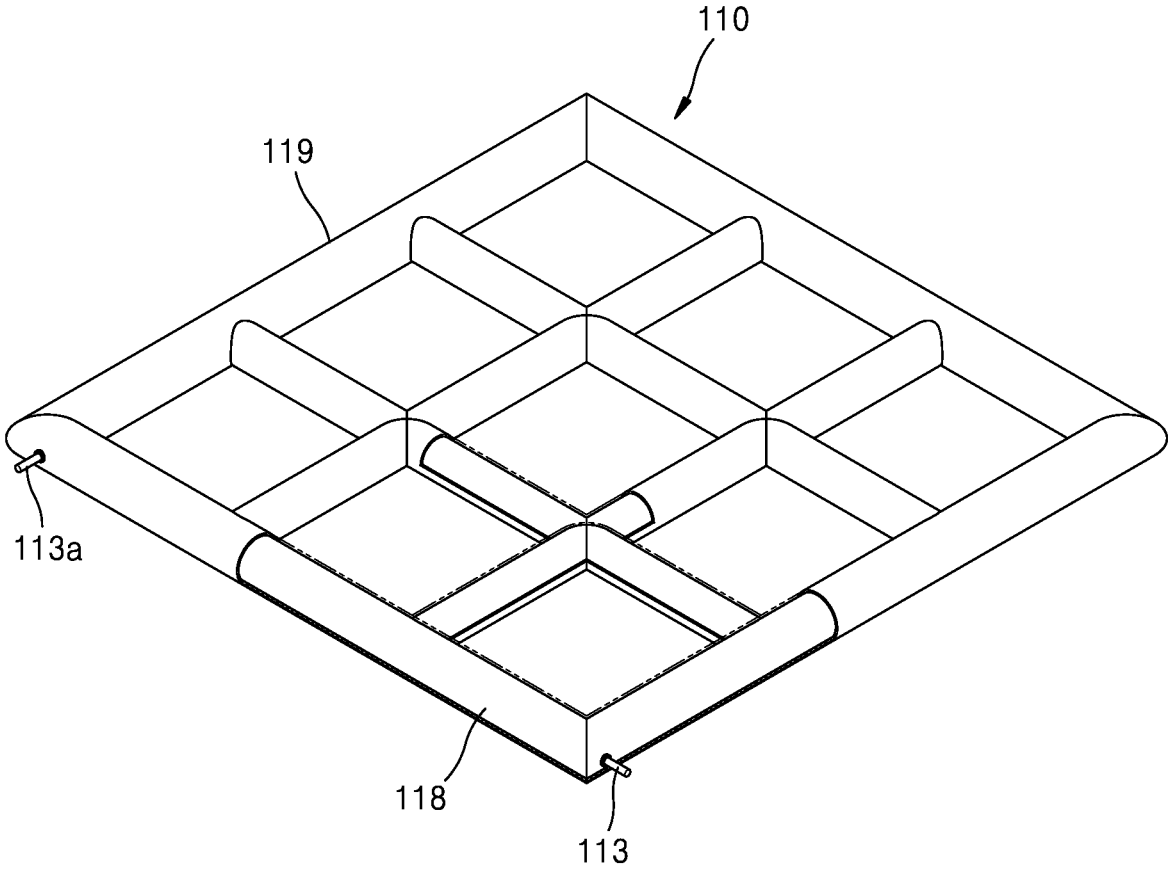
FIG. 11 is a view illustrating a frame having a double-layer structure including a first frame and a second frame, according to an embodiment of the present disclosure.
Figure 12A:
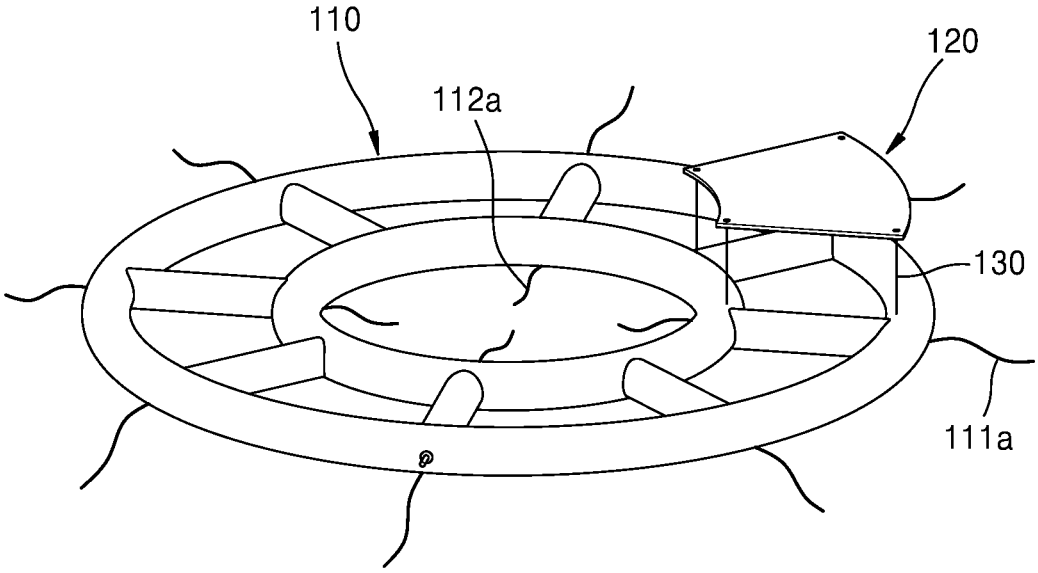
FIG. 12A through 12D are views illustrating various shapes of a frame, according to an embodiment of the present disclosure, where.
Figure 12B:
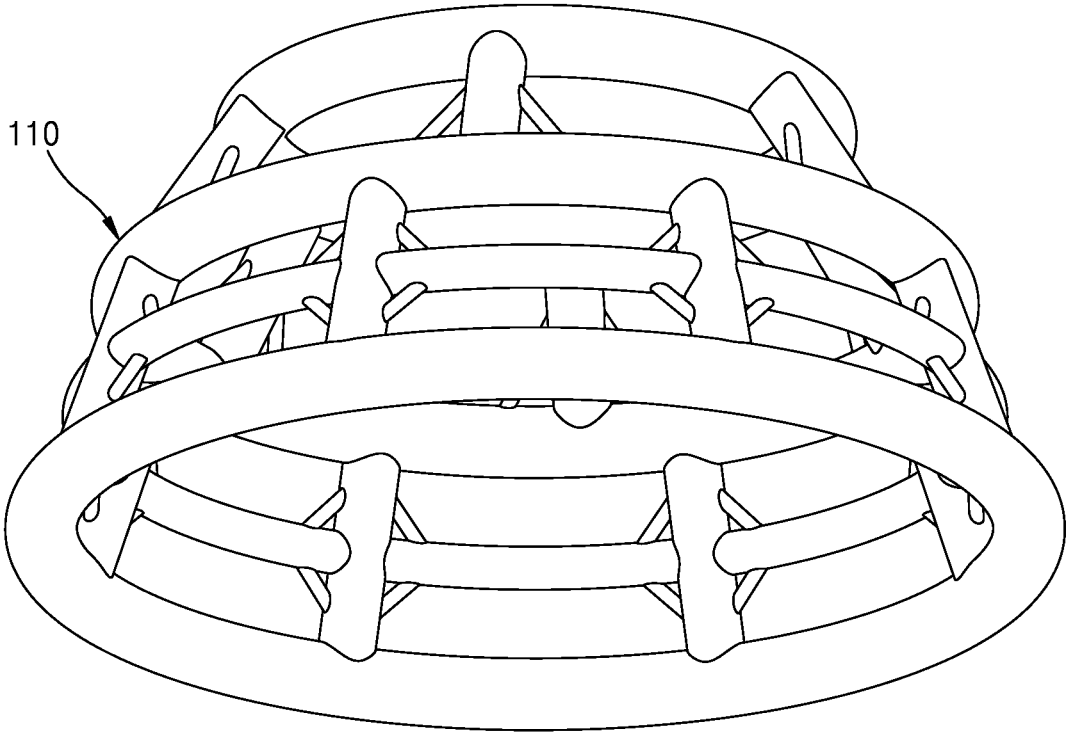
Figure 12C:
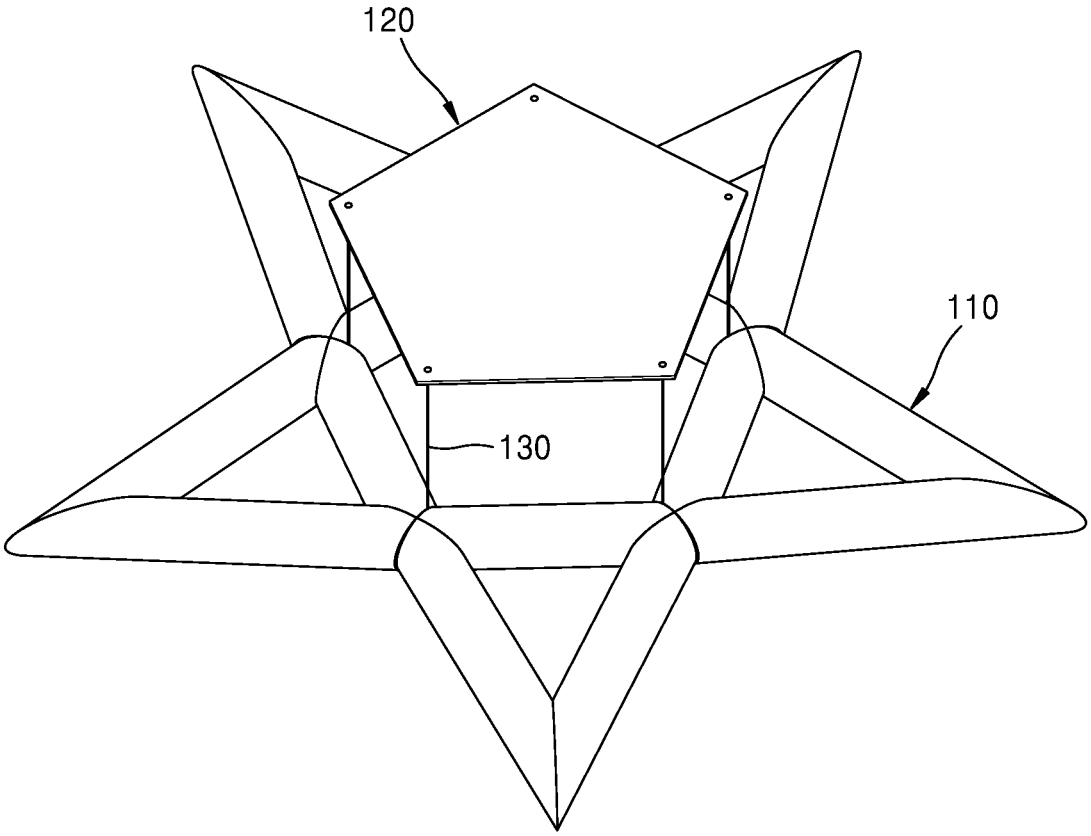
Figure 12D:
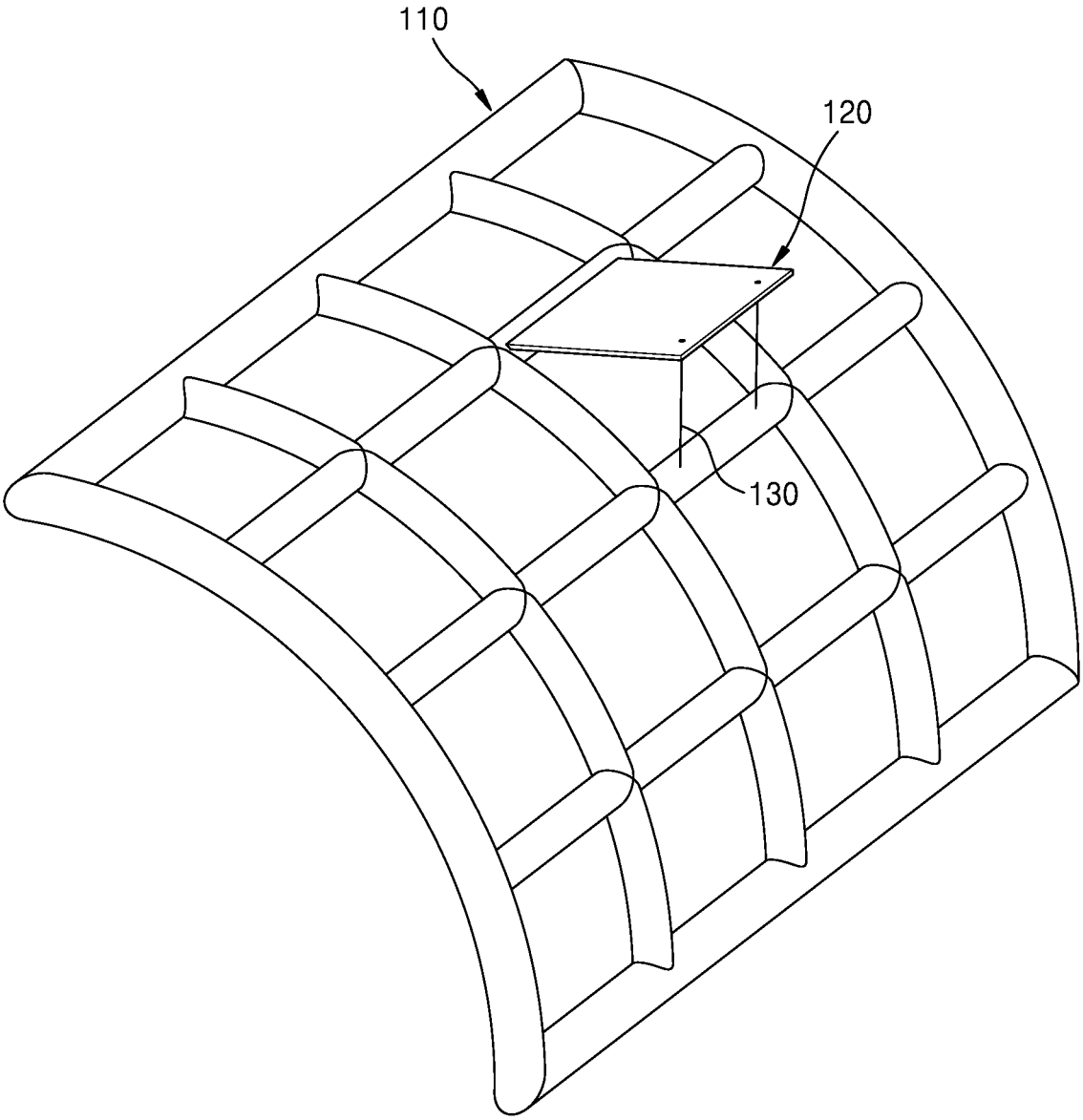

Referring to FIG. 11, the frame 110 according to an embodiment of the present disclosure may have a double-layer structure including a first frame 118 into which gas is injected and a second frame 119 that surrounds the first frame 118 and into which gas is injected.

In detail, the first frame 118 is provided inside the second frame 119. The frame 110 may have a double-layer structure in which the first frame 118 having a cylindrical vinyl shape is located inside the second frame 119. Accordingly, leakage of gas may be prevented.

The gas injection hole 113 through which gas may be injected may be provided in the second frame 119, and a first gas injection hole 113*a* through which gas may be injected may also be provided in the first frame 118.

Although the frame 110 according to an embodiment of the present disclosure has a quadrangular shape, the present disclosure is not limited thereto. As long as the frame 110 has an inner space through which air may pass, the frame 110 may have any of various shapes as shown in FIGS. 12A through 12D.

Also, a shade tarp using an advertising balloon according to an embodiment of the present disclosure may include a pouch 180 in which the shade tarp may be received when the shade tarp is not used, and an edge cover portion 181 that is formed around the inner space of the frame 110.

Figure 13:
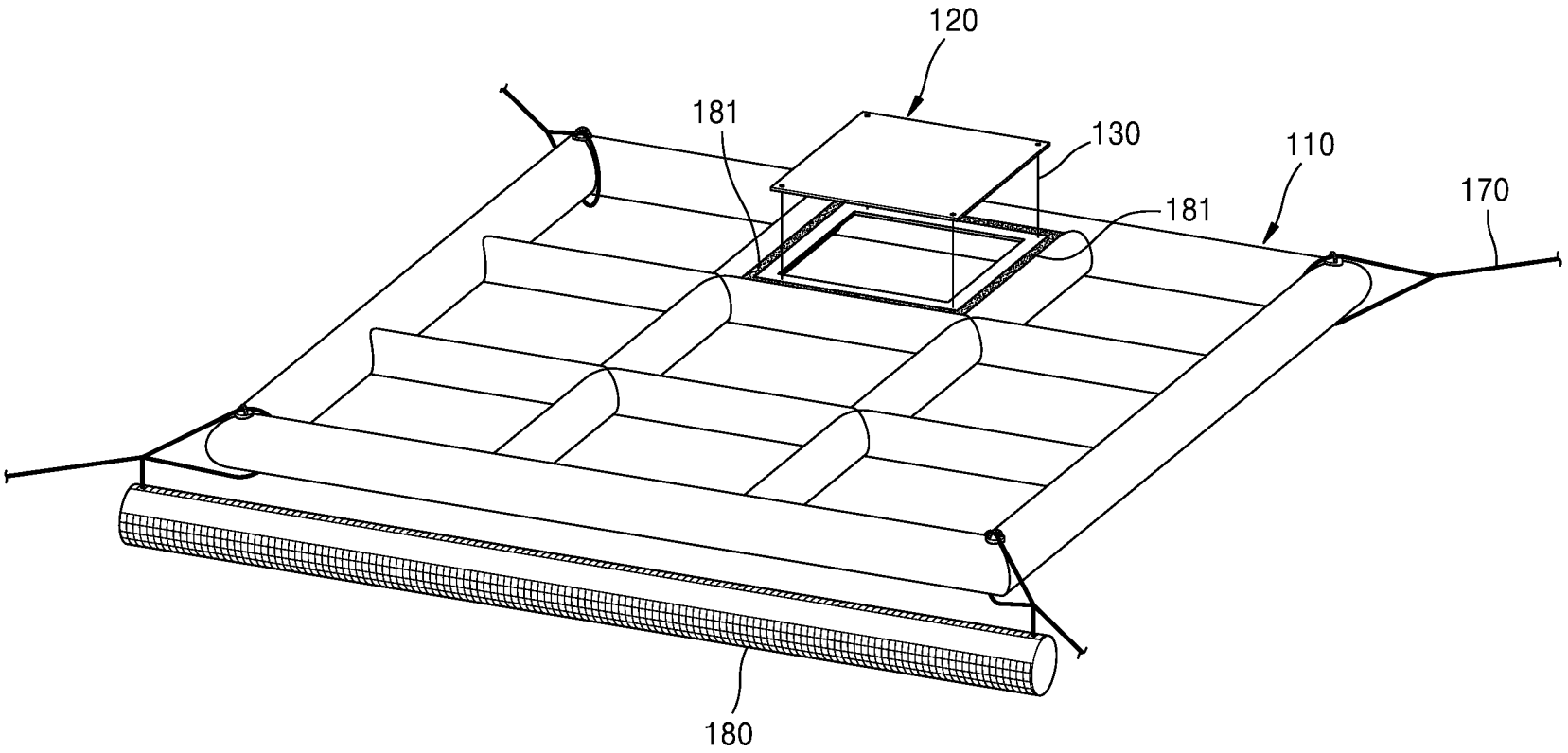
FIG. 13 is a view illustrating a pouch and an edge cover portion, according to an embodiment of the present disclosure.

Referring to FIG. 13, the pouch 180 may contain a shade tarp therein and may prevent the shade tarp from being damaged when wind suddenly blows. The pouch 180 may be a net pouch or a vinyl pouch.

The edge cover portion 181 provided in the frame 110 is formed around an inner space formed inside the frame 110. When the cover portion 120 is lifted by wind, there is a risk that sunlight is introduced into a space formed between the cover portion 120 and the frame 110. The edge cover portion 181 may prevent sunlight from being introduced into the space formed between the cover portion 120 and the frame 110.

The edge cover portion 181 into which gas may be injected may protrude above the frame 110 to prevent sunlight from being introduced into the space formed between the cover portion 120 and the frame 110. The edge cover portion 181 may be integrally formed with the frame 110.

Figure 14A:
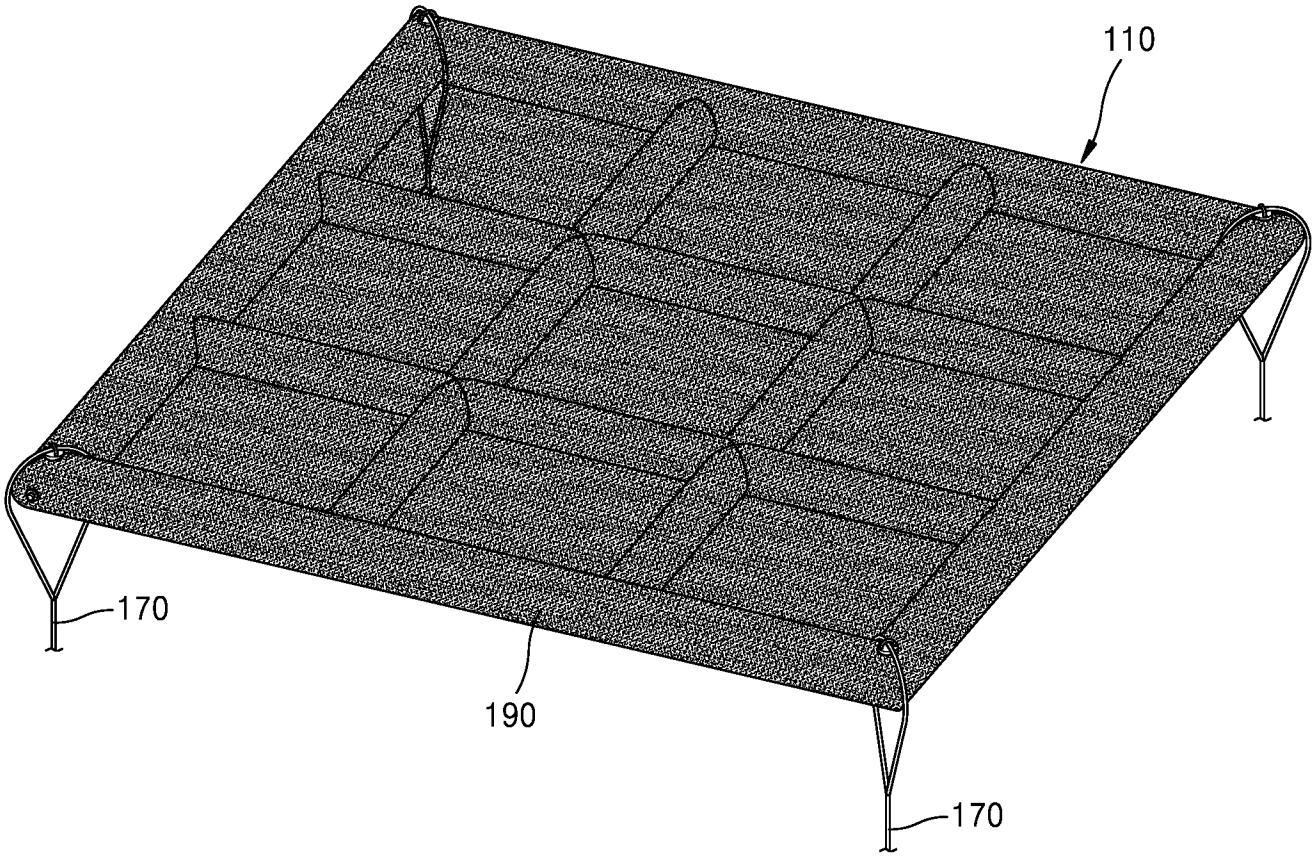
FIG. 14A is a view illustrating that a safety net covers a frame, according to an embodiment of the present disclosure.
Figure 14B:
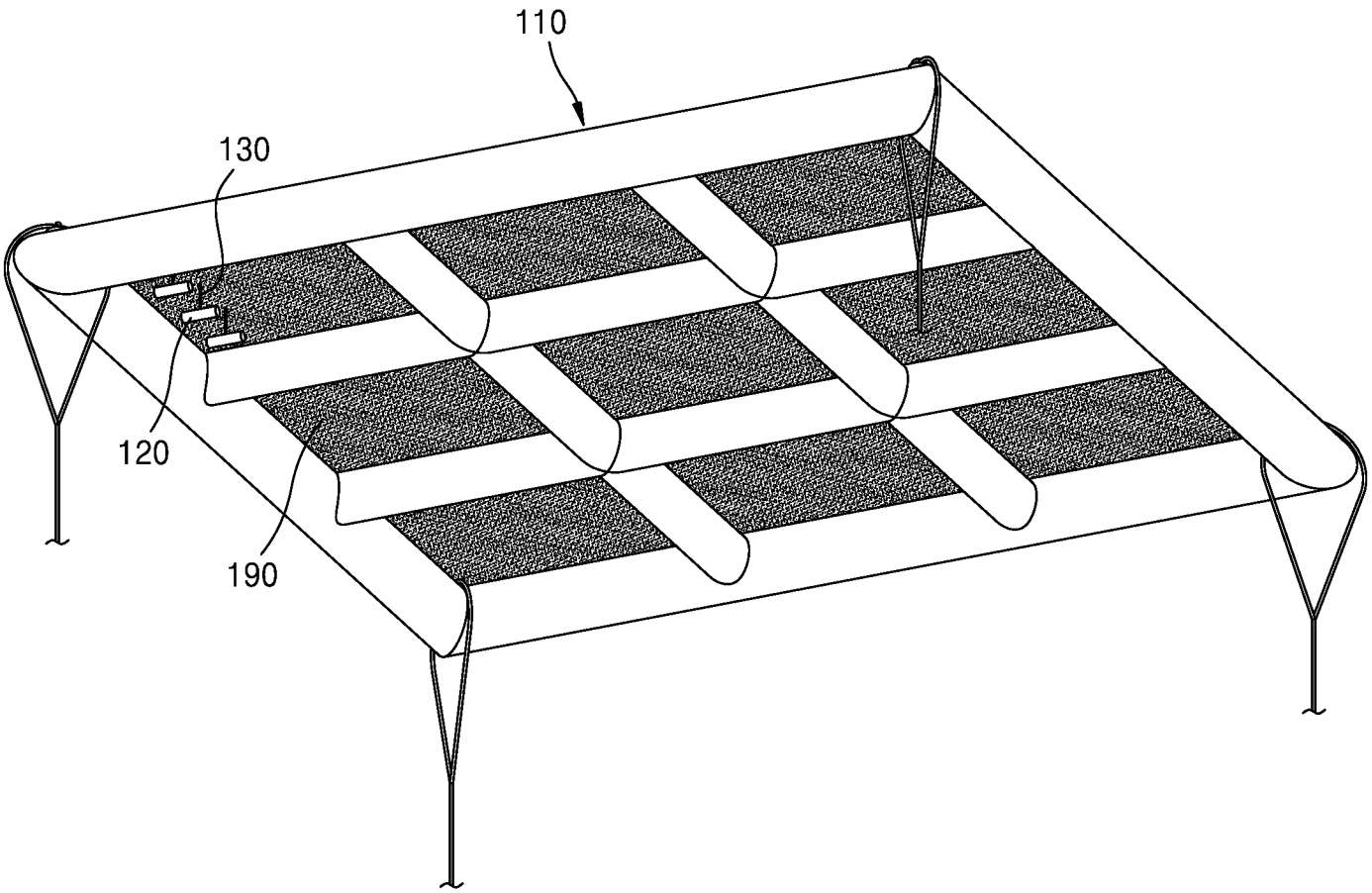
FIG. 14B is a view illustrating that an auxiliary cover portion is combined to the safety net, according to an embodiment of the present disclosure.
Figure 14C:
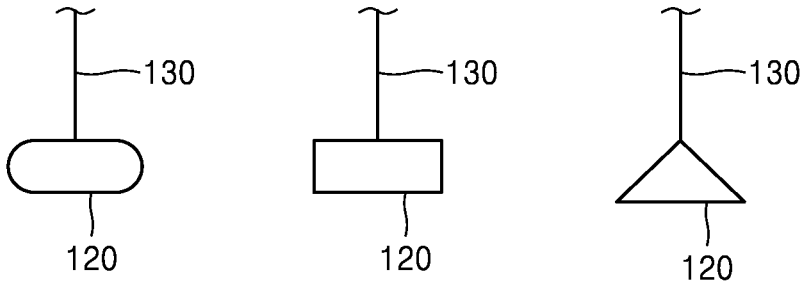
FIG. 14C is a view illustrating a shape of the auxiliary cover portion, according to an embodiment of the present disclosure.

Referring to FIGS. 14A, 14B, and 14C, a shade tarp using an advertising balloon according to an embodiment of the present disclosure may further include a safety net 190 configured to cover the frame 110, an auxiliary cover portion 191 combined to the safety net 190 or the frame 110 and configured to cover an inner space formed inside the frame 110, and an auxiliary connector 192 configured to connect the safety net 190 or the frame 110 to the auxiliary cover portion 191.

The safety net 190 may cover the frame 110, and the frame 110 and the safety net 190 may be combined to each other and the frame 110 may float in the air. The safety net 190 may be fixed at a designated point, and the frame 110 may safely float through the safety net 190.

The auxiliary cover portion 191 that may cover the inner space formed inside the frame 110 may be combined to the safety net 190. The auxiliary cover portion 191 may assist the cover portion 120 to form a shade tarp, and may be combined to a lower portion of the safety net 190.

The auxiliary cover portion 191 may be combined through the auxiliary connector 192, and the auxiliary connector 192 may be formed of a string. When the auxiliary cover portion 191 is combined to the safety net 190 through the auxiliary connector 192 formed of a string, the inner space of the frame 110 may be covered by the auxiliary cover portion 191 when the frame 110 is covered by the safety net 190.

Referring to FIG. 14C, the auxiliary cover portion 191 may have any of various shapes according to a shape of the inner space formed inside the frame 110. Although the auxiliary cover portion 191 is combined to the safety net 190, the present disclosure is not limited thereto, and the auxiliary cover portion 191 may be combined to the frame 110. The auxiliary cover portion 191 may cover the inner space of the frame 110 while being combined to the frame 110 through the auxiliary connector 192.

Figure 15:
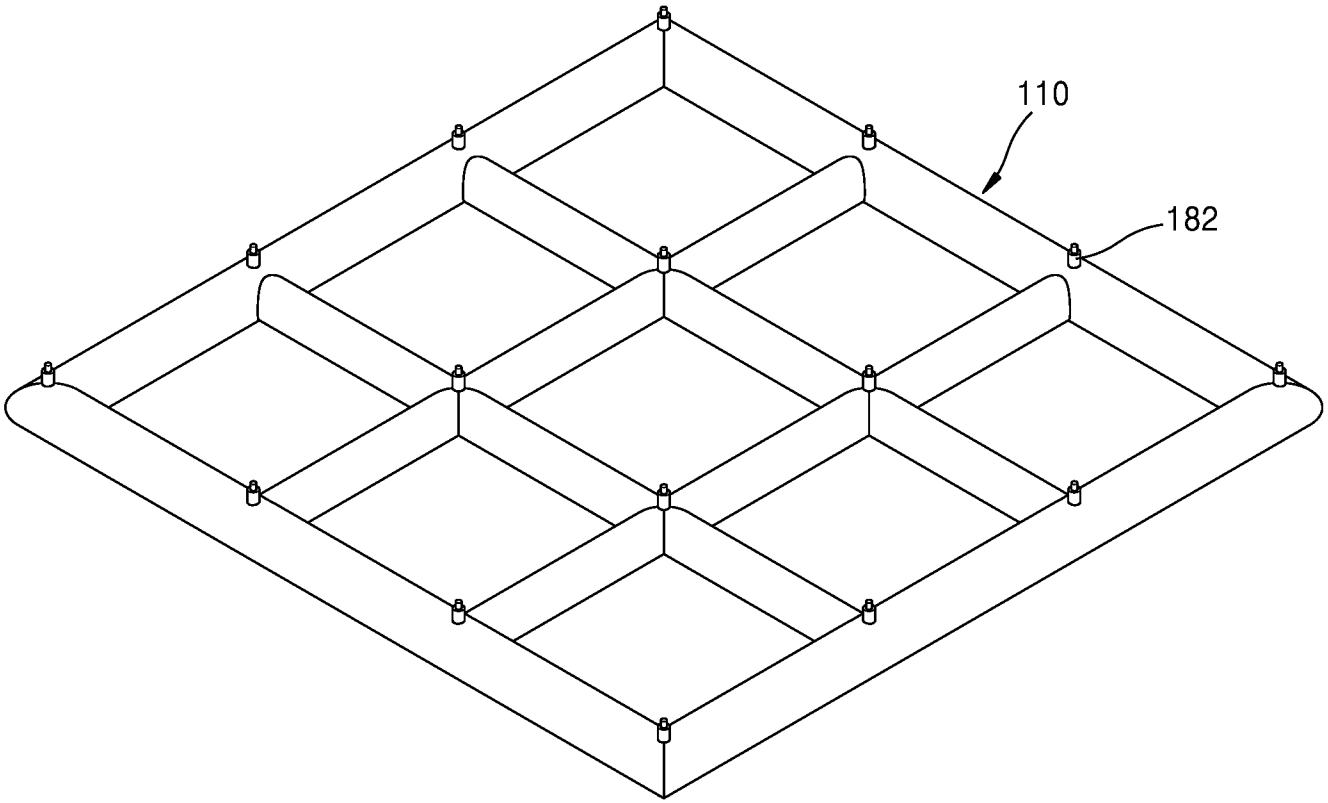
FIG. 15 is a view illustrating that a protrusion is provided on a frame, according to an embodiment of the present disclosure.

Also, referring to FIG. 15, a protrusion 185 protruding upward from the frame 110 may be provided on the frame 110.

When the safety net 190 covers the frame 110, the protrusion 182 may increase a distance between the safety net 190 and the inner space of the frame 110. As a distance between the safety net 192 and the inner space of the frame 110 increases through the protrusion 182, a space where the auxiliary cover portion 191 is located may be secured.

The protrusion 182 may be integrally formed with the frame 110, and gas may be injected into the protrusion 182. It is preferable that the protrusion 182 is provided on the frame 110 at a point where the protrusion 182 is not caught by the cover portion 120.

Figure 16:
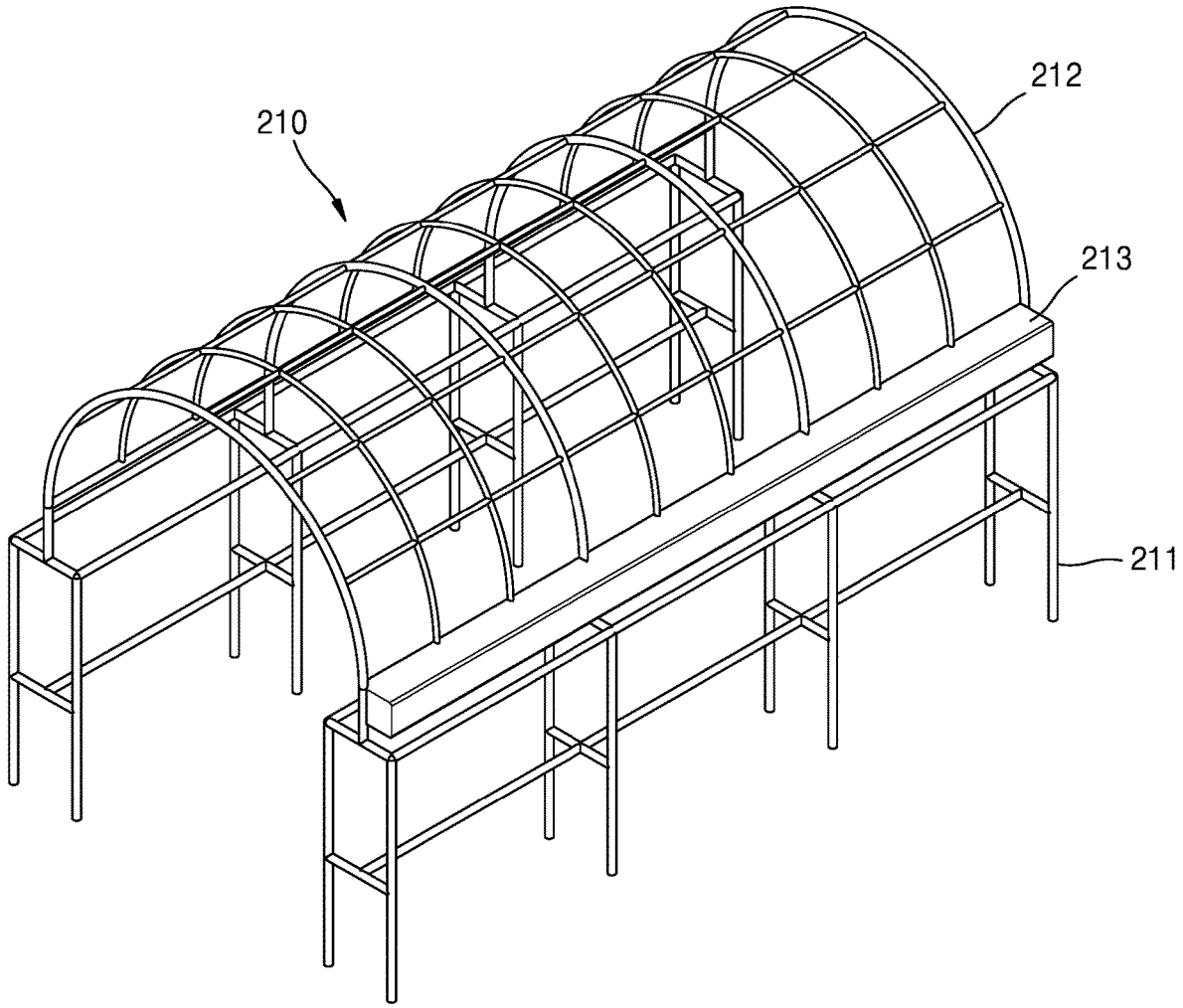
FIG. 16 is a view illustrating a support structure on which a frame is installed, according to an embodiment of the present disclosure.

Referring to FIG. 16, a shade tarp using an advertising balloon according to an embodiment of the present disclosure may be installed and used on a support structure 210 installed on the ground. The support structure 210 may be any of various structures installed on the ground, and may be a structure having a lattice shape and having an empty space.

In detail, the support structure 210 may include a post 211 and a support 212. The post 211 may be a structure installed on the ground, and the support 212 may be a structure installed on the post 211 and having a lattice structure and an empty space.

The frame 110 according to an embodiment of the present disclosure may be installed on the support structure 210, and the empty space of the support structure 210 may be covered by the cover portion 120 provided on the frame 110. The cover portion 120 may allow ventilation between the support structure 210 and the cover portion 120 to form a shade tarp.

The support structure 210 may further include a shade tarp box 213. The shade tarp box 213 is a box in which a shade tarp may be quickly folded and put for the safety of the shade tarp when strong wind suddenly blows. The shade tarp box 213 may be installed on a side of the support structure 210.

A shade tarp using an advertising balloon according to another embodiment of the present disclosure may be modified and used as follows.

Figure 17A:
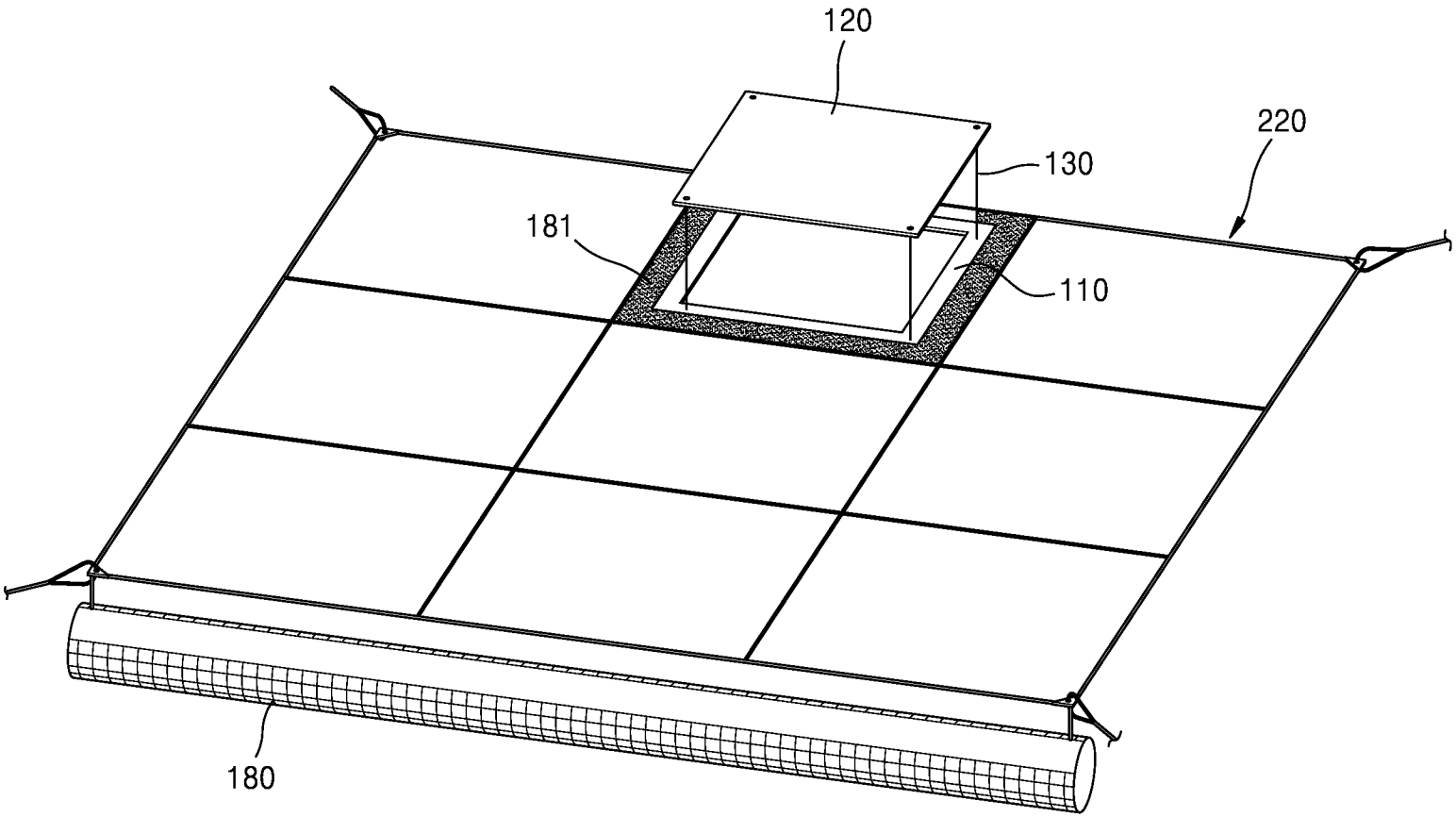
FIG. 17A illustrates that a frame is installed on a net structure, according to another embodiment of the present disclosure.

Referring to FIG. 17A, the frame 110 may be combined to a net structure 220 formed of a string or a cord in a lattice shape. The net structure 220 may have a lattice structure through a string such as a fishing line, and the frame 110 may be combined to the string of the net structure 220.

Figure 17B:
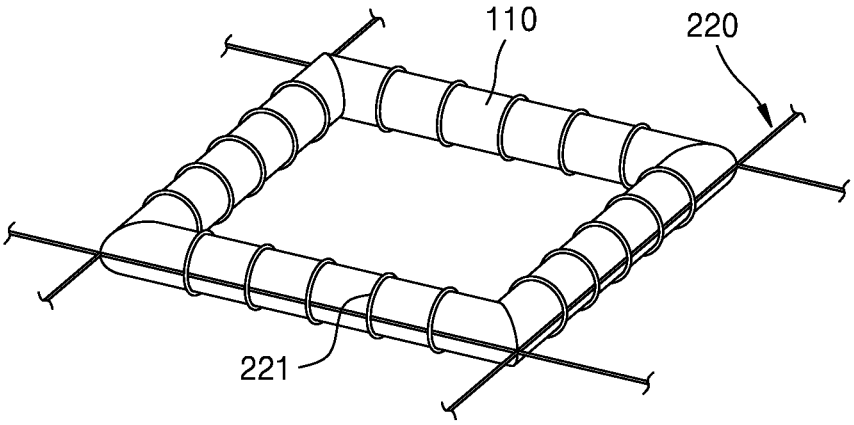
FIG. 17B illustrates that a frame is installed on a net structure with a combining string, according to another embodiment of the present disclosure.

Referring to FIG. 17B, the frame 110 may be combined to the net structure 220 by using a combining string 221, and the cover portion 120 may be provided on the frame 110 to cover an empty space of the frame 110.

Figure 18:
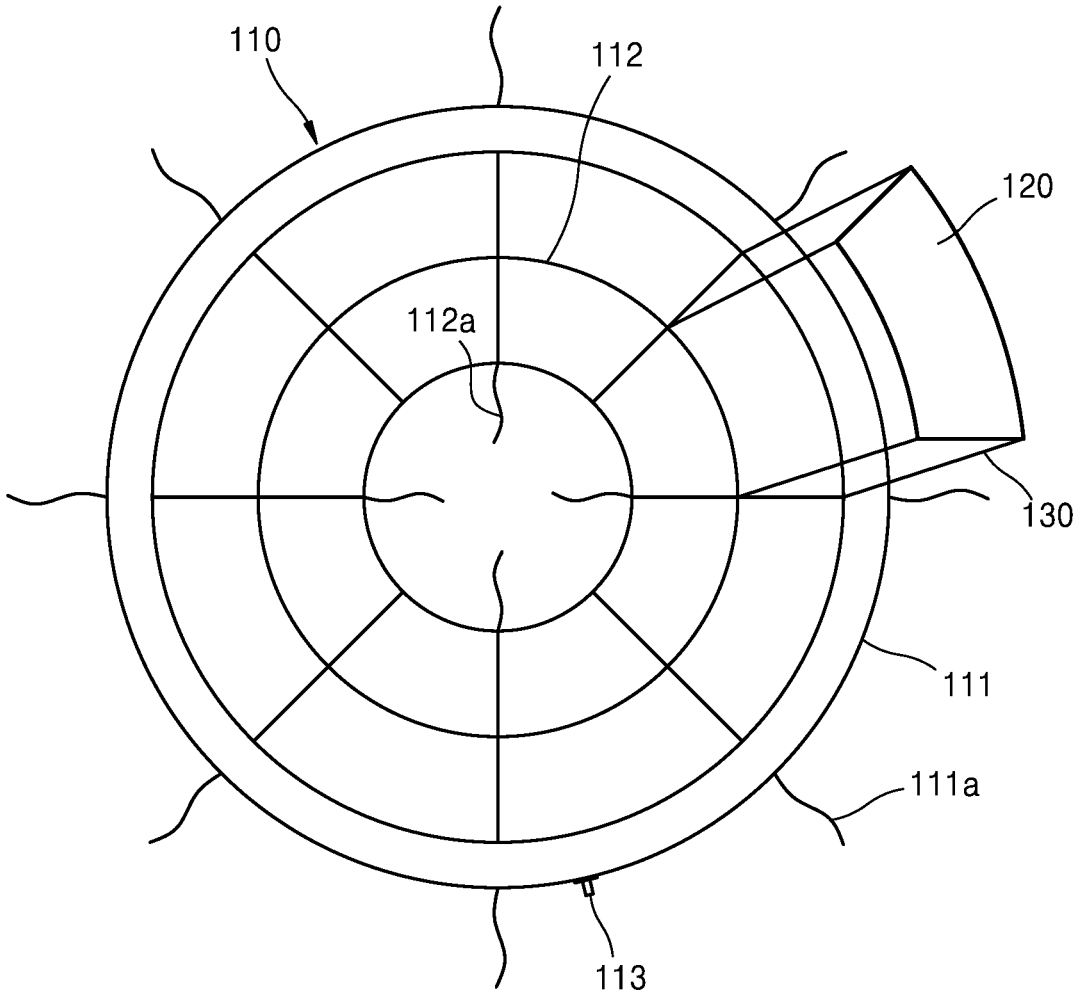
FIG. 18 is a view illustrating that an inner frame that is formed of a string and is a circular net-type frame with an empty space is located inside an outer frame into which gas is injected, according to another embodiment of the present disclosure.

Referring to FIG. 18, gas may be injected into the outer frame 111 according to another embodiment of the present disclosure, and the inner frame 112 may be formed of a string or a cord. The inner frame 112 may be a circular net type-frame with an empty space. The cover portion 120 may cover a space formed by the inner frame 112 or a space formed by the inner frame 112 and the outer frame 111.

An outer cord 111*a* for fixing the outer frame 111 may be provided on the outer frame 111, and an inner cord 112*a* for fixing the inner frame 112 may be provided on the inner frame 112.

A shade tarp using an advertising balloon according to the one or more embodiments of the present disclosure has the following effects.

A shade tarp using an advertising balloon according to an embodiment of the present disclosure has advantages in that as a cover portion is upward-movably installed on a frame that is lifted into the air by injecting gas into the frame, ventilation is possible between the frame and the cover portion and shade is provided under the frame through the cover portion that floats high in the air.

Also, the shade tarp using the advertising balloon according to an embodiment of the present disclosure has advantages in that as the cover portion is provided on the frame that is lifted into the air to provide shade, a space under the frame may be secured, and as the flow of air under the frame becomes smooth, cool shade may be provided.

Also, the shade tarp using the advertising balloon according to an embodiment of the present disclosure has advantages in that as the frame has a double structure, leakage of gas may be prevented, and as the cover portion is provided on the frame that is lifted into the air to provide shade, installation cost may be low.

While the present disclosure has been particularly shown and described with reference to embodiments thereof, they are provided for the purposes of illustration, and it will be understood by one of ordinary skill in the art that various modifications and equivalent other embodiments made be made from the present disclosure. Accordingly, the true technical scope of the present disclosure is defined by the technical spirit of the appended claims.

The invention claimed is:

1. A shade tarp using an advertising balloon for creating shade on a ground, the shade tarp comprising:

a frame comprising an outer frame into which gas is injected and an inner frame provided inside the outer frame;

a cover portion configured to cover an inner space formed inside the frame;

a connector configured to connect the cover portion to the frame, wherein the connector is configured to connect the cover portion to the frame so that the cover portion is movable with respect to the frame; and the frame has a cylindrical shape and includes a twisted portion in which the frame having the cylindrical shape is twisted; and a fixing cover configured to be combined to the twisted portion, and has any one of an L-shape, a T-shape, and a cross shape.

2. The shade tarp of claim 1, wherein the cover portion comprises an edge portion to which the connector is combined, and a sun-shielding portion provided inside the edge portion, wherein gas is injected into the sun-shielding portion.

3. The shade tarp of claim 1, wherein an outer cord for fixing the outer frame is provided on the outer frame, and an inner cord for fixing the inner frame is provided on the inner frame.

4. The shade tarp of claim 1, wherein a base support having a first end and a second end combined to the frame is provided in the inner space formed inside the frame.

5. The shade tarp of claim 4, wherein a plurality of base supports are combined in the inner space formed inside the frame, wherein the first end and the second end of each of the plurality of base supports are combined to any one point of an upper portion, a middle portion, and a lower portion of the frame.

6. The shade tarp of claim 1, wherein the connector comprises a movable portion having a bar shape combined to protrude toward an upper portion of the frame, and a lid portion provided on an end of the movable portion, wherein a connection hole is formed in the cover portion, and the cover portion is fitted to the movable portion through the connection hole, and the lid portion has a width greater than a width of the connection hole of the cover portion.

7. The shade tarp of claim 6, wherein the movable portion is combined to a top surface of the frame or an inner surface of the frame.

8. The shade tarp of claim 6, wherein the cover portion is fitted to the movable portion and movable, or is fitted to the movable portion and fixed to an upper portion of the movable portion.

9. The shade tarp of claim 1, wherein the connector comprises:

a first connector configured to connect a first side of the cover portion to the frame so that the side of the cover portion is movable upward with respect to the frame, and a second connector configured to connect a second side of the cover portion to the frame so that the second side of the cover portion is fixedly combined to the frame so as not to be movable upward, wherein the cover portion is hinged to the frame so that the first side of the cover portion is movable upward.

10. The shade tarp of claim 9, wherein the first connector connects the cover portion to the side of the frame, and comprises a first movable portion having a bar shape combined to protrude toward an upper portion of the frame and a first lid portion provided on an end of the first movable portion, wherein the first movable portion extends in an upward oblique direction relative to the frame.

11. The shade tarp of claim 9, wherein a spring is provided on the second connector.

12. The shade tarp of claim 1, wherein the connector comprises a first connector configured to connect a first side of the cover portion to the frame so that the side of the cover portion is movable upward relative to the frame, a second connector configured to connect a middle portion of the cover portion to the frame, while the middle portion of the cover portion is fixedly combined to the frame so that the middle portion of the cover portion is not movable upward relative to the frame, and a third connector configured to connect a second side of the cover portion to the frame so that the other side of the cover portion is movable upward relative to the frame.

13. The shade tarp of claim 1, wherein at least one twisted portion is further configured to have two or three twisted portions.

14. The shade tarp of claim 1, wherein the frame comprises a rope fixing member, and further comprises a rope inserted into the rope fixing member, wherein the rope extends below the frame, wherein the connector connects the cover portion to the rope so that the cover portion is movable relative to the frame.

15. The shade tarp of claim 14, wherein a moving fixing portion that does not pass through the rope fixing member is provided on the rope.

16. The shade tarp of claim 1, wherein the cover portion comprises a plurality of layers.

17. The shade tarp of claim 1, wherein the frame has a double-layer structure comprising a first frame into which gas is injected and a second frame that surrounds the first frame and into which gas is injected.

18. The shade tarp of claim 1, further comprising a safety net having a net shape and configured to cover the frame, an auxiliary cover portion combined to the safety net or the frame and configured to cover the inner space formed in the frame, and an auxiliary connector configured to connect the auxiliary cover portion to the safety net or the frame.

19. The shade tarp of claim 1, wherein the frame is installed on a support structure installed on the ground.

* * * * *